US007932425B2

(12) United States Patent
Blessing et al.

(10) Patent No.: US 7,932,425 B2
(45) Date of Patent: Apr. 26, 2011

(54) METHOD OF ENHANCING AN AROMATIZATION CATALYST

(75) Inventors: Christopher D. Blessing, Jubail Industrial (SA); Scott H. Brown, Kingwood, TX (US); Tin-Tack Peter Cheung, Kingwood, TX (US); David J. Glova, Lyman, SC (US); Daniel M. Hasenberg, Kingwood, TX (US); Dennis L. Holtermann, Kingwood, TX (US); Gyanesh P. Khare, Kingwood, TX (US); Daniel B. Knorr, Jr., Seattle, WA (US)

(73) Assignee: Chevron Phillips Chemical Company LP, The Woodlands, TX (US)

( * ) Notice: Subject to any disclaimer, the term of this patent is extended or adjusted under 35 U.S.C. 154(b) by 914 days.

(21) Appl. No.: 11/780,693

(22) Filed: Jul. 20, 2007

(65) Prior Publication Data

US 2008/0027255 A1 Jan. 31, 2008

Related U.S. Application Data

(60) Provisional application No. 60/820,748, filed on Jul. 28, 2006.

(51) Int. Cl.
*C07C 2/52* (2006.01)
*C10G 35/06* (2006.01)

(52) U.S. Cl. ..... 585/419; 585/418; 208/138; 208/139

(58) Field of Classification Search ..... 585/419, 585/418; 208/139, 138
See application file for complete search history.

(56) References Cited

U.S. PATENT DOCUMENTS

| | | | |
|---|---|---|---|
| 2,642,383 | A | 6/1953 | Berger et al. |
| 2,952,611 | A | 9/1960 | Haxton et al. |
| 3,474,026 | A | 10/1969 | Derr, Jr. et al. |
| 3,540,996 | A | 11/1970 | Maziuk et al. |
| 3,649,524 | A | 3/1972 | Derr et al. |
| 3,816,300 | A | 6/1974 | Gallagher et al. |
| 4,104,320 | A | 8/1978 | Bernard et al. |
| 4,434,311 | A | 2/1984 | Buss et al. |

(Continued)

FOREIGN PATENT DOCUMENTS

EP 0374321 A1 6/1990

(Continued)

OTHER PUBLICATIONS

Foreign communication from a related counterpart application—International Search Report and Written Opinion, PCT/US2004/014848, Sep. 27, 2004, 6 pages.*

(Continued)

*Primary Examiner* — Thuan Dinh Dang
(74) *Attorney, Agent, or Firm* — Conley Rose, P.C.; Rodney B. Carroll; Chad E. Walter

(57) ABSTRACT

A hydrocarbon aromatization process comprising adding a nitrogenate, an oxygenate, or both to a hydrocarbon stream to produce an enhanced hydrocarbon stream, and contacting the enhanced hydrocarbon stream with an aromatization catalyst, thereby producing an aromatization reactor effluent comprising aromatic hydrocarbons, wherein the catalyst comprises a non-acidic zeolite support, a group VIII metal, and one or more halides. Also disclosed is a hydrocarbon aromatization process comprising monitoring the presence of an oxygenate, a nitrogenate, or both in an aromatization reactor, monitoring at least one process parameter that indicates the activity of the aromatization catalyst, modifying the amount of the oxygenate, the nitrogenate, or both in the aromatization reactor, thereby affecting the parameter.

20 Claims, 13 Drawing Sheets

U.S. PATENT DOCUMENTS

| | | | |
|---|---|---|---|
| 4,435,283 | A | 3/1984 | Buss et al. |
| 4,447,316 | A | 5/1984 | Buss |
| 4,456,527 | A | 6/1984 | Buss et al. |
| 4,458,025 | A | 7/1984 | Lee et al. |
| 4,517,306 | A | 5/1985 | Buss |
| 4,547,472 | A | 10/1985 | Van Nordstrand |
| 4,579,831 | A | 4/1986 | Field |
| 4,608,356 | A | 8/1986 | Buss et al. |
| 4,634,518 | A | 1/1987 | Buss et al. |
| 4,645,586 | A | 2/1987 | Buss |
| 4,648,961 | A | 3/1987 | Jacobson et al. |
| 4,721,694 | A | 1/1988 | Buss et al. |
| 4,741,819 | A | 5/1988 | Robinson et al. |
| 4,761,512 | A | 8/1988 | Katsuno et al. |
| 4,830,732 | A | 5/1989 | Mohr et al. |
| 4,912,072 | A | 3/1990 | Mallouk et al. |
| 5,106,803 | A | 4/1992 | Mohr et al. |
| 5,182,012 | A | 1/1993 | Miller et al. |
| 5,328,595 | A | 7/1994 | Rainis |
| 5,354,933 | A | 10/1994 | Ohashi et al. |
| 5,366,617 | A | 11/1994 | Bradley et al. |
| 5,401,365 | A | 3/1995 | Chen et al. |
| 5,401,386 | A | 3/1995 | Morrison et al. |
| 5,461,016 | A | 10/1995 | Bradley et al. |
| 5,558,767 | A | 9/1996 | Ressl |
| 5,674,376 | A | 10/1997 | Heyse et al. |
| 5,863,418 | A | 1/1999 | Heyse et al. |
| 5,877,367 | A | 3/1999 | Witte |
| 5,879,538 | A | 3/1999 | Haritatos |
| 6,004,452 | A | 12/1999 | Ash et al. |
| 6,063,264 | A | 5/2000 | Haritatos |
| 6,063,724 | A | 5/2000 | Resasco et al. |
| 6,096,936 | A | 8/2000 | Fukunaga et al. |
| 6,107,236 | A | 8/2000 | Pecoraro et al. |
| 6,132,595 | A | 10/2000 | Bogdan et al. |
| 6,190,539 | B1 | 2/2001 | Holtermann et al. |
| 6,207,042 | B1 | 3/2001 | Holtermann et al. |
| 6,323,381 | B1 | 11/2001 | Nacamuli et al. |
| 6,372,685 | B1 | 4/2002 | Pecoraro et al. |
| 6,406,614 | B1 | 6/2002 | Tiedtke et al. |
| 6,518,470 | B1 | 2/2003 | Fukunaga et al. |
| 6,812,180 | B2 | 11/2004 | Fukunaga |
| 7,153,801 | B2 | 12/2006 | Wu |
| 2002/0193240 | A1 | 12/2002 | Fukunaga |

FOREIGN PATENT DOCUMENTS

| | | | |
|---|---|---|---|
| EP | 1508608 | A1 | 2/2005 |
| GB | 1102356 | A | 2/1968 |
| GB | 2142648 | A | 1/1985 |
| WO | 2005000464 | A1 | 1/2005 |
| WO | 2008014428 | A2 | 1/2008 |
| WO | 2008014428 | A3 | 1/2008 |

OTHER PUBLICATIONS

Foreign communication from a related counterpart application—International Preliminary Report on Patentability, PCT/US2004/014848, Dec. 19, 2005, 5 pages.*

Foreign communication from a related counterpart application—International Preliminary Report on Patentability, PCT/US2007/074531, Feb. 3, 2009, 8 pages.*

International Search Report and Written Opinion, PCT/US07/074531, Sep. 22, 2008, 13 pages.

* cited by examiner

METHOD OF ENHANCING AN AROMATIZATION CATALYST

CROSS-REFERENCE TO RELATED APPLICATIONS

The present application claims priority to U.S. Provisional Patent Application Ser. No. 60/820,748 filed Jul. 28, 2006 by Blessing et al. and entitled "Method of Activating an Aromatization Catalyst", which is incorporated herein by reference as if reproduced in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

The disclosure generally relates to aromatization of hydrocarbons with an aromatization catalyst. Specifically, the disclosure relates to a method for activating and/or enhancing an aromatization catalyst by the addition of an oxygenate, a nitrogenate, or both.

The catalytic conversion of hydrocarbons into aromatic compounds, referred to as aromatization or reforming, is an important industrial process. The aromatization reactions may include dehydrogenation, isomerization, and hydrocracking the hydrocarbons, each of which produces specific aromatic compounds. These reactions are generally conducted in one or more aromatization reactors containing an aromatization catalyst. The catalyst may increase the reaction rates, production of desired aromatics, and/or the throughput rates for the desired aromatic compounds. Given their commercial importance, an ongoing need exists for improved methods and systems related to aromatization processes and catalysts.

SUMMARY

In one aspect, the disclosure includes a hydrocarbon aromatization process comprising adding a nitrogenate, an oxygenate, or both to a hydrocarbon stream to produce an enhanced hydrocarbon stream, and contacting the enhanced hydrocarbon stream with an aromatization catalyst, thereby producing an aromatization reactor effluent comprising aromatic hydrocarbons, wherein the catalyst comprises a non-acidic zeolite support, a group VIII metal, and one or more halides.

In another aspect, the disclosure includes a hydrocarbon aromatization process comprising adding a nitrogenate, an oxygenate, or both to a hydrocarbon stream to produce an enhanced hydrocarbon stream, to a hydrogen recycle stream to produce an enhanced recycle stream, or to both, contacting the enhanced hydrocarbon stream, enhanced recycle stream, or both with an aromatization catalyst in an aromatization reactor to produce an aromatization reactor effluent comprising aromatic hydrocarbons, and controlling the addition of the nitrogenate, the oxygenate, or both to the enhanced hydrocarbon stream, the enhanced recycle stream, or both in order to maintain one or more process parameters within a desired range.

In yet another aspect, the disclosure includes a hydrocarbon aromatization process comprising monitoring the presence of an oxygenate, a nitrogenate, or both in an aromatization reactor, monitoring at least one process parameter that indicates the activity of the aromatization catalyst, modifying the amount of the oxygenate, the nitrogenate, or both in the aromatization reactor, thereby affecting the parameter.

DETAILED DESCRIPTION

Novel methods and systems for aromatizing hydrocarbons and/or activating, preserving, and/or increasing the productivity of an aromatization catalyst are disclosed herein. Generally, it has been thought that water and impurities that can be converted to water are detrimental to aromatization catalysts, causing sintering of the platinum, thereby damaging the catalyst. Thus, the conventional wisdom is that water, oxygenates, or nitrogenates should be rigorously purged from the aromatization system. For example, it has generally been considered advantageous to substantially reduce or eliminate the presence of water and oxygen in the hydrocarbon feed to the aromatization system and/or a hydrogen recycle stream within the aromatization system when using the catalysts described herein. Specifically, water levels as low as a half part per million by volume (0.5 ppmv) in the feed and the hydrogen recycle have been desirable. Such generally accepted wisdom is evidenced by the presence of hydrotreaters and dryers in the feed stream and dryers in the hydrogen recycle stream of conventional aromatization processes. Contrary to such commonly accepted wisdom, the inventors have found that some water is beneficial in activating, preserving, and/or increasing the productivity of certain types of aromatization catalysts. Specifically, an oxygenate, a nitrogenate, or mixtures thereof may be inserted into the aromatization system at various times, in various locations, and in various manners, thereby causing a specific amount of water and/or ammonia to be present in one or more aromatization reactors during the aromatization process. In an embodiment, the presence of the specific amount of water and/or ammonia in the aromatization reactor activates or enhances the aromatization catalyst.

Figure 1:
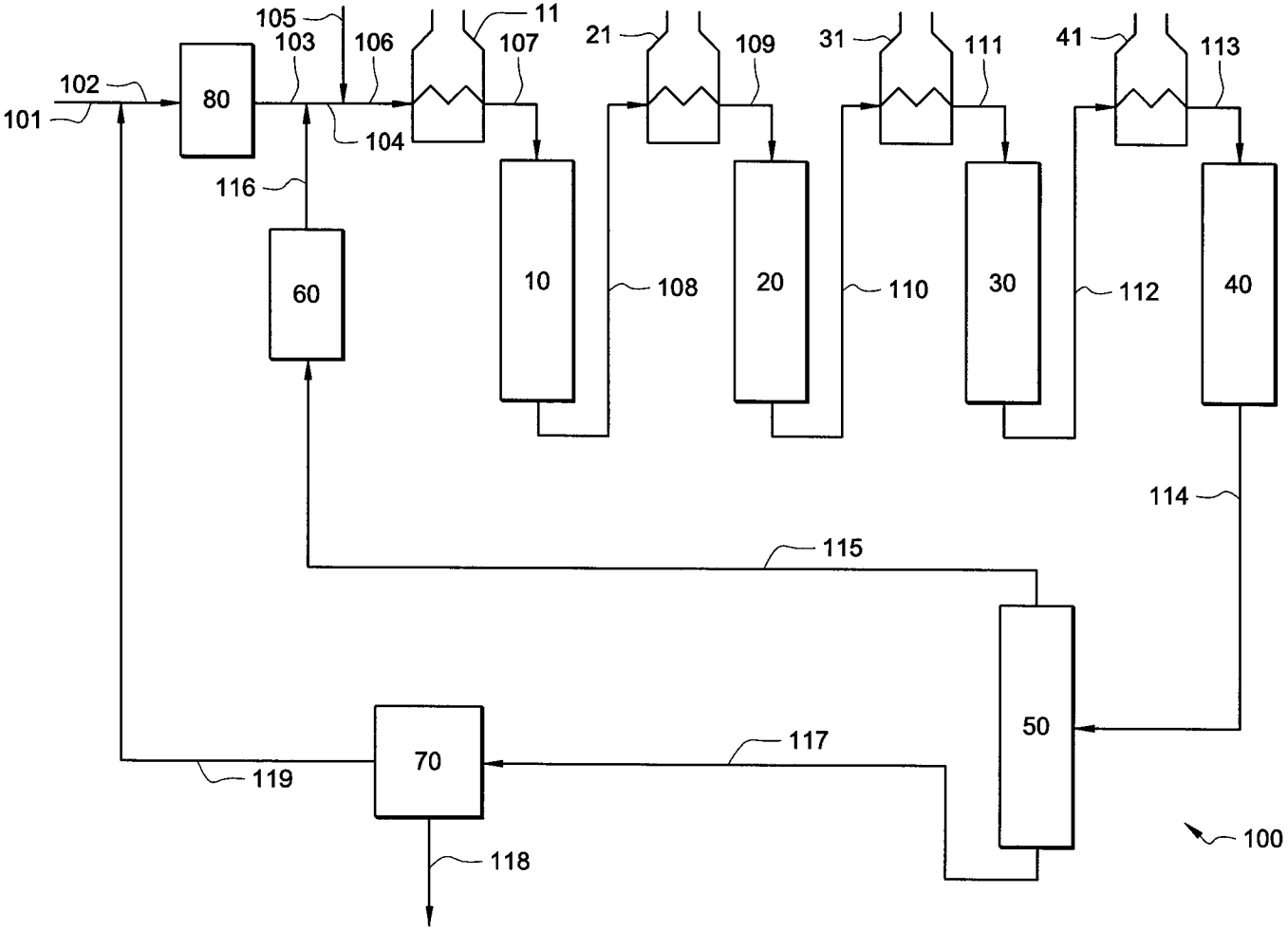
FIG. 1 is a process flow diagram showing one embodiment of an aromatization system.

FIG. 1 illustrates one embodiment of a catalytic reactor system 100 suitable for use in an aromatization system and process as described herein. In the embodiment shown in FIG. 1, the catalytic reactor system 100 comprises four aromatization reactors in series: reactors 10, 20, 30, and 40. However, the catalytic reactor system 100 may comprise any suitable number and configuration of aromatization reactors, for example one, two, three, five, six, or more reactors in series or in parallel. As aromatization reactions are highly endothermic, large temperature drops occur across the reactors 10, 20, 30, and 40. Therefore, each reactor 10, 20, 30, and 40 in the series may comprise a corresponding furnace 11, 21, 31, and 41, respectively, for reheating components back to a desired temperature for maintaining a desired reaction rate. Alternatively, one or more reactors 10, 20, 30, and 40 may share a common furnace where practical. All of the reactors 10, 20, 30, and 40, furnaces 11, 21, 31, and 41, and associated piping may be referred to herein as the reaction zone.

In FIG. 1, the hydrocarbon feed 101 is combined with recycle stream 119 to form combined feed stream 102, which is fed into purification process 80. The purification process 80 employs known processes to purify the hydrocarbon feed, which may include fractionation and/or treating the hydrocarbon feed. As used herein, the term "Fractionation" includes removing heavy (e.g., $C_9^+$) hydrocarbons and/or light (e.g., $C_5^-$) hydrocarbons. As used herein, the term "Treating" and "Removing" refer interchangeably to removing impurities, such as oxygenates, sulfur, and/or metals, from the hydrocarbon feed. The resulting purified feed 103 may be combined with a dry hydrogen recycle 116 to produce hydrogen rich purified feed 104, which may then be combined with the oxygenate and/or the nitrogenate 105 to produce a reactor feed stream 106. Oxygenate and/or nitrogenate may be fed to the reactor system 100 at one or more locations in addition to stream 105 or as an alternative to stream 105, as will be described in more detail herein.

The reactor feed stream 106 is pre-heated in a first furnace 11, which heats the hydrocarbons to a desired temperature, thereby producing a first reactor feed 107. First reactor feed 107 is fed into reactor 10, where the hydrocarbons are contacted with an aromatization catalyst under suitable reaction conditions (e.g., temperature and pressure) that aromatize one or more components in the feed, thereby increasing the aromatics content thereof. A first reactor effluent 108 comprising aromatics, unreacted feed, and other hydrocarbon compounds or byproducts are recovered from the first reactor 10.

The first reactor effluent 108 is then pre-heated in the second furnace 21, which heats the hydrocarbons to a desired temperature, thereby producing a second reactor feed 109. Second reactor feed 109 is then fed into reactor 20, where the hydrocarbons are contacted with an aromatization catalyst under suitable reaction conditions for aromatizing one or more components in the feed to increase the aromatics content thereof. A second reactor effluent 110 comprising aromatics, unreacted feed, and other hydrocarbon compounds or byproducts are recovered from the second reactor 20.

The second reactor effluent 110 is then pre-heated in the third furnace 31, which heats the hydrocarbons to a desired temperature, thereby producing a third reactor feed 111. Third reactor feed 111 is then fed into reactor 30, where the hydrocarbons are contacted with an aromatization catalyst under suitable reaction conditions for aromatizing one or more components in the feed to increase the aromatics content thereof. A third reactor effluent 112 comprising aromatics, unreacted feed, and other hydrocarbon compounds or byproducts is recovered from the third reactor 30.

The third reactor effluent 112 is then pre-heated in the fourth furnace 41, which heats the hydrocarbons to a desired temperature, thereby producing a fourth reactor feed 113. Fourth reactor feed 113 is then fed into reactor 40, where the hydrocarbons are contacted with an aromatization catalyst under suitable reaction conditions for aromatizing one or more components in the feed to increase the aromatics content thereof. A fourth reactor effluent 114 comprising aromatics, unreacted feed, and other hydrocarbon compounds or byproducts is recovered from the fourth reactor 40.

The fourth reactor effluent 114 is then fed into a hydrogen separation process 50 that uses a number of known processes to separate a hydrogen recycle 115 from a reformate 117. The reformate 117 comprises the aromatization reaction products from reactors 10, 20, 30, and 40 (e.g., aromatic and non-aromatic compounds) in addition to any unreacted feed and other hydrocarbon compounds or byproducts. The hydrogen recycle 115 may be dried in a dryer 60, thereby forming dry hydrogen recycle 116, which may then be recycled into the purified feed 103. The reformate 117 goes to a purification-extraction process 70, which separates the raffinate recycle 119 and reactor byproducts (not shown) from the aromatics 118. The hydrogen separation processes 50 and the purification-extraction processes 70 are well known in the art and are described in numerous patents, including U.S. Pat. No. 5,401,386 to Morrison et al. entitled "Reforming Process for Producing High-Purity Benzene", U.S. Pat. No. 5,877,367 to Witte entitled "Dehydrocyclization Process with Downstream Dimethylbenzene Removal", and U.S. Pat. No. 6,004,452 to Ash et al. entitled "Process for Converting Hydrocarbon Feed to High Purity Benzene and High Purity Paraxylene", each of which is incorporated herein by reference as if reproduced in its entirety. The raffinate recycle 119 is then recycled into the feed 101 and the aromatics 118 are sold or otherwise used as desired. For the sake of simplicity, FIG. 1 does not illustrate the byproduct streams that are removed from the catalytic reactor system 100 at various points throughout the system. However, persons of ordinary skill in the art are aware of the composition and location of such byproduct streams. Also, while FIG. 1 shows the oxygenate and/or nitrogenate 105 being added to hydrogen rich purified feed 104, persons of ordinary skill in the art will appreciate that the oxygenate and/or nitrogenate may be added to any of process streams 101, 102, 103, 104, 106, 107, 108, 109, 110, 111, 112, 113, 114, 115, 116, 117, 119, or various combinations thereof.

In various embodiments, the catalytic reactor system described herein may comprise a fixed catalyst bed system, a moving catalyst bed system, a fluidized catalyst bed system, or combinations thereof. Such reactor systems may be batch or continuous. In an embodiment, the catalytic reactor system is a fixed bed system comprising one or more fixed bed reactors. In a fixed bed system, the feed may be preheated in furnace tubes and passed into at least one reactor that contains a fixed bed of the catalyst. The flow of the feed can be upward, downward, or radially through the reactor. In various embodiments, the catalytic reactor system described herein may be operated as an adiabatic catalytic reactor system or an isothermal catalytic reactor system. As used herein, the term "catalytic reactor" and "reactor" refer interchangeably to the reactor vessel, reactor internals, and associated processing equipment, including but not limited to the catalyst, inert packing materials, scallops, flow distributors, center pipes, reactor ports, catalyst transfer and distribution system, furnaces and other heating devices, heat transfer equipment, and piping.

In an embodiment, the catalytic reactor system is an aromatization reactor system comprising at least one aromatization reactor and its corresponding processing equipment. As used herein, the terms "aromatization," "aromatizing," and "reforming" refer to the treatment of a hydrocarbon feed to provide an aromatics enriched product, which in one embodiment is a product whose aromatics content is greater than that of the feed. Typically, one or more components of the feed undergo one or more reforming reactions to produce aromatics. Some of the hydrocarbon reactions that occur during the aromatization operation include the dehydrogenation of cyclohexanes to aromatics, dehydroisomerization of alkylcyclopentanes to aromatics, dehydrocyclization of acyclic hydrocarbons to aromatics, or combinations thereof. A number of other reactions also occur, including the dealkylation of alkylbenzenes, isomerization of paraffins, hydrocracking reactions that produce light gaseous hydrocarbons, e.g., methane, ethane, propane and butane, or combinations thereof.

The aromatization reaction occurs under process conditions that thermodynamically favor the dehydrocyclization reaction and limit undesirable hydrocracking reactions. The pressures may be from about 0 pounds per square inch gauge (psig) to about 500 psig, alternatively from about 25 psig to about 300 psig. The molar ratio of hydrogen-to-hydrocarbons may be from about 0.1:1 to about 20:1, alternatively from about 1:1 to about 6:1. The operating temperatures include reactor inlet temperatures from about 700° F. to about 1050° F., alternatively from about 900° F. to about 1000° F. Finally, the liquid hourly space velocity (LHSV) for the hydrocarbon feed over the aromatization catalyst may be from about 0.1 to about 10 $hr^{-1}$, alternatively from about 0.5 to about 2.5 $hr^{-1}$.

The composition of the feed is a consideration when designing catalytic aromatization systems. In an embodiment, the hydrocarbon feed comprises non-aromatic hydrocarbons containing at least six carbon atoms. The feed to the aromatization system is a mixture of hydrocarbons comprising $C_6$ to $C_8$ hydrocarbons containing up to about 10 wt % and alternatively up to about 15 wt % of $C_5$ and lighter hydrocarbons ($C_5^-$) and containing up to about 10 wt % of $C_9$ and heavier hydrocarbons ($C_9^+$). Such low levels of $C_9^+$ and $C_5^-$ hydrocarbons maximize the yield of high value aromatics. In some embodiments, an optimal hydrocarbon feed maximizes the percentage of $C_6$ hydrocarbons. Such a feed can be achieved by separating a hydrocarbon feedstock such as a fill range naphtha into a light hydrocarbon feed fraction and a heavy hydrocarbon feed fraction, and using the light fraction.

In another embodiment, the feed is a naphtha feed. The naphtha feed may be a light hydrocarbon, with a boiling range of about 70° F. to about 450° F. The naphtha feed may contain aliphatic, naphthenic, or paraffinic hydrocarbons. These aliphatic and naphthenic hydrocarbons are converted, at least in part, into aromatics in the aromatization reactor system. While catalytic aromatization typically refers to the conversion of naphtha, other feedstocks can be treated as well to provide an aromatics enriched product. Therefore, while the conversion of naphtha is one embodiment, the present disclosure can be useful for activating catalysts for the conversion or aromatization of a variety of feedstocks such as paraffin hydrocarbons, olefin hydrocarbons, acetylene hydrocarbons, cyclic paraffin hydrocarbons, cyclic olefin hydrocarbons, and mixtures thereof, and particularly saturated hydrocarbons.

In an embodiment, the feedstock is substantially free of sulfur, metals, and other known poisons for aromatization catalysts, and is initially substantially free of oxygenates and nitrogenates. If present, such poisons can be removed using methods known to those skilled in the art. In some embodiments, the feed can be purified by first using conventional hydrofining techniques, then using sorbents to remove the remaining poisons. Such hydrofining techniques and sorbents are included in the purification process described below.

In an embodiment, an oxygenate, a nitrogenate, or both may be added to one or more process streams and/or components in the catalytic reactor system 100. As used herein, the term "oxygenate" refers to water or any chemical compound that forms water under catalytic aromatization conditions, such as oxygen, oxygen-containing compounds, hydrogen peroxide, alcohols, ketones, esters, ethers, carbon dioxide, aldehydes, carboxylic acids, lactones, ozone, carbon monoxide or combinations thereof. In one embodiment, water and/or steam is used as the oxygenate. In another embodiment, oxygen may be used as the oxygenate, wherein such oxygen converts to water in situ within one or more aromatization reactors under typical aromatization conditions or within one or more hydrofining catalyst or sorbent beds under normal hydrofining conditions. Furthermore, the oxygenate may be any alcohol-containing compound. Specific examples of suitable alcohol-containing compounds are methanol, ethanol, propanol, isopropanol, butanol, t-butanol, pentanol, amyl alcohol, hexanol, cyclohexanol, phenol, or combinations thereof.

As used herein, the term "nitrogenate" refers to ammonia or any chemical compound that forms ammonia under catalytic aromatization conditions such as nitrogen, nitrogen-containing compounds, alkyl amines, aromatic amines, pyridines, pyridazines, pyrimidines, pyrazines, triazines, heterocyclic N-oxides, pyrroles, pyrazoles, imadazoles, triazoles, nitriles, amides, ureas, imides, nitro compounds, nitroso compounds, or combinations thereof. While not wanting to be limited by theory, it is believed that the ammonia will improve catalyst activity in much the same way as the water. Additionally, all the methods of addition and control for oxygenates described herein can also be fully applied additionally or alternatively to the methods of addition and control for nitrogenates.

Persons of ordinary skill in the art will appreciate that any of the oxygenates, nitrogenates, or mixtures thereof described herein may be used alone, in combination, or further combined to produce other suitable oxygenates or nitrogenates. In some embodiments, the oxygenate and nitrogenate may be contained within the same bifunctional compound. The oxygenate and/or nitrogenate may be added in any suitable physical phase such as a gas, liquid, or combinations thereof. The oxygenate and/or nitrogenate may be added to one or more process streams and/or components via any suitable means for their addition, for example a pump, injector, sparger, bubbler, or the like. The oxygenate and/or nitrogenate may be introduced as a blend with a carrier. In some embodiments, the carrier is hydrogen, a hydrocarbon, nitrogen, a noble gas, or mixtures thereof. In a preferred embodiment, the carrier is hydrogen.

The oxygenate and/or nitrogenate may be added at various locations within the aromatization system described herein. For example, the oxygenate and/or nitrogenate may be added to one or more process streams in the catalytic reactor system 100, to one or more equipment components or vessels of the catalytic reactor system 100, or combinations thereof. In an embodiment, the oxygenate and/or nitrogenate may be added at one or more locations within a reaction zone defined by the reactor system 100, wherein the reaction zone comprises process flow lines, equipment, and/or vessels wherein reactants are undergoing an aromatization reaction. In one embodiment, the oxygenate and/or nitrogenate is added between the purification process 80 and the first furnace 11, either before the addition of the dry hydrogen recycle 116, or after the addition of the dry hydrogen recycle 116 as depicted in FIG. 1. Alternatively, the oxygenate and/or nitrogenate may be added within the purification process 80. However, it is also contemplated that the oxygenate and/or nitrogenate can be added at various other locations within the catalytic reactor system 100. For example, the oxygenate and/or nitrogenate can be added to the feed 101, the combined feed 102, the first reactor feed 107, the first reactor effluent 108, the second reactor feed 109, the second reactor effluent 110, the third reactor feed 111, the third reactor effluent 112, the fourth reactor feed 113, or combinations thereof. In addition, the oxygenate and/or nitrogenate could be added to the fourth reactor effluent 114, the hydrogen recycle 115, the dry hydrogen recycle 116, the reformate 117, the raffinate recycle 119, or combinations thereof. Furthermore, the oxygenate and/or nitrogenate can be added to any combination of the aforementioned streams, directly to any of the reactors 10, 20, 30, or 40, directly to the furnaces 11, 21, 31, 41, or combinations thereof. Likewise, the oxygenate and/or nitrogenate can be added directly to any other process equipment or component of the catalytic reactor system 100 such as a pump, value, port, tee, manifold, etc. Finally, it is possible to add the oxygenate and/or nitrogenate to any process equipment or component upstream of the catalytic reactor system 100 such as a tank, pump, value, port, tee, manifold, etc. that supplies the feed 101 to the catalytic reactor system.

The oxygenate and/or nitrogenate may be added to the aromatization process at any time during the service life of the aromatization catalyst. As used herein, the term "time" may refer to the point in the service life of the aromatization catalyst at which the oxygenate and/or nitrogenate is added to the catalyst. For example, the oxygenate and/or nitrogenate may be added at the beginning of the life of the aromatization catalyst, e.g. when or soon after a new batch of catalyst is brought online. Alternatively, the oxygenate and/or nitrogenate may be added to the catalyst close to or at the end of the catalyst run. The end of the catalyst run may be determined using any of the methods described herein and known in the art, such as a time-based lifetime such as 1,000 days online, or a temperature-based lifetime exceeds a defined value, e.g., 1000° F., which often is based upon process limitations such as reactor metallurgy. Further, the oxygenate and/or nitrogenate may be added continuously during the lifetime of the catalyst, e.g. from when the catalyst is brought online to when the catalyst is taken offline. Finally, the oxygenate and/or nitrogenate may be added to the aromatization catalyst at any combination of these times, such as at the beginning and at the end of a catalyst lifetime, but not continuously.

Figure 2A:
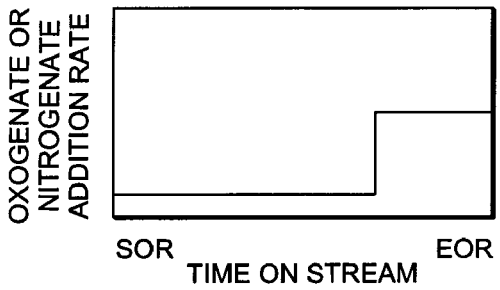
FIG. 2A illustrates one manner for adding the oxygenate and/or the nitrogenate to the aromatization catalyst.
Figure 2B:
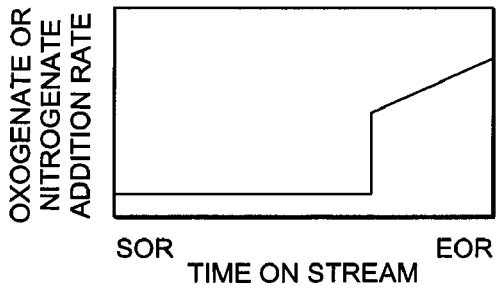
FIG. 2B illustrates another manner for adding the oxygenate and/or the nitrogenate to the aromatization catalyst.
Figure 2C:
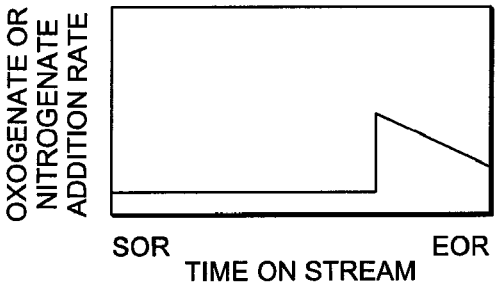
FIG. 2C illustrates another manner for adding the oxygenate and/or the nitrogenate to the aromatization catalyst.
Figure 2D:
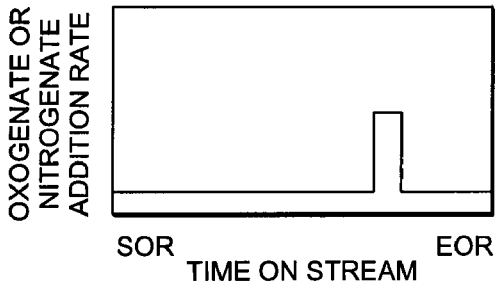
FIG. 2D illustrates another manner for adding the oxygenate and/or the nitrogenate to the aromatization catalyst.

In addition, the oxygenate and/or nitrogenate may be added to the aromatization process in any suitable manner. As used herein, the term "manner" may refer to the addition profile of the oxygenate and/or nitrogenate, for example how the addition of the oxygenate and/or nitrogenate to the catalyst changes over time. FIGS. 2A, 2B, 2C, and 2D illustrate four manners in which the oxygenate and/or nitrogenate may be added to the aromatization catalyst. Specifically, FIG. 2A illustrates the case where the oxygenate and/or nitrogenate is added as a constant-level step increase. Such would be the case when the oxygenate and/or nitrogenate is increased from about 2 ppmv to about 10 ppmv during the catalyst life. The step may be an increase or a decrease in oxygenate and/or nitrogenate levels. FIG. 2B illustrates the case where the amount of oxygenate and/or nitrogenate is increased a step change and then at a steady rate (e.g., constant slope) over time. Such would be the case when the oxygenate and/or nitrogenate is increased from 0 to 2 ppmv at a start point, and thereafter at a rate of 0.2 ppmv/day. In such an embodiment, the increase in oxygenate and/or nitrogenate at a steady rate may be preceded by an initial step, as shown in FIG. 2B, or may lack the initial step (i.e., may start at 0 ppmv). FIG. 2C illustrates the case where the amount of oxygenate and/or nitrogenate is decreased at a steady rate over time. Such would be the case when the oxygenate and/or nitrogenate is decreased at a rate of 0.2 ppmv/day. In such an embodiment, the increase in oxygenate and/or nitrogenate may be preceded by an initial step, as shown in FIG. 2C, or may lack the initial step, such as when it is desirable to reduce the oxygenate and/or nitrogenate levels. FIG. 2D illustrates the case where the oxygenate and/or nitrogenate is added as a pulse. Such would be the case when the oxygenate and/or nitrogenate is increased from about 2 ppmv to about 10 ppmv for two days, then returned to 2 ppmv. The oxygenate and/or nitrogenate may be added in multiple pulses, if desired.

While the addition profiles illustrated in FIGS. 2A, 2B, 2C, and 2D are shown near the end of the catalyst life, those addition profiles may be implemented at any point during the catalyst life. Specifically, the addition profiles illustrated in FIGS. 2A, 2B, 2C, and 2D may be implemented at the beginning of the catalyst life, shortly after the beginning of the catalyst life, at any point during the catalyst life, or at the end of the catalyst life. In addition, the oxygenate and/or nitrogenate may be added in any combinations of the above manners, such as two pulses followed by an increasing amount of oxygenate and/or nitrogenate at a constant rate.

The addition of the oxygenate and/or nitrogenate to the aromatization process may be a function of any of the aforementioned locations, times, and/or manners. For example, the sole consideration in adding the oxygenate and/or nitrogenate to the aromatization process may be the time when the oxygenate and/or nitrogenate is added to the aromatization process, the location where the oxygenate and/or nitrogenate is added to the aromatization process, or the manner in which the oxygenate and/or nitrogenate is added to the aromatization process. However, the oxygenate and/or nitrogenate will typically be added to the aromatization process using a combination of these considerations. For example, the oxygenate and/or nitrogenate may be added in a combination of times and locations irrespective of manner, times and manners irrespective of locations, or locations and manners irrespective of times. Alternatively, the time, location, and manner may all be considerations when adding the oxygenate and/or nitrogenate to the aromatization system.

In an embodiment, the addition of oxygenate and/or nitrogenate to the catalytic reactor system 100 as described herein functions to activate the aromatization catalyst, wherein such catalyst might otherwise be inactive or display insufficient activity in the absence of the addition of oxygenate. For example, certain types of aromatization catalysts such as L-zeolite supported platinum containing one or more halogens such as F and/or Cl may not activate or may have inadequate activity where the feed to the reactors, e.g., 10, 20, 30, 40, is substantially free of oxygenate, for example containing less than about 1 ppmv total oxygenate and/or nitrogenate, alternatively less than about 0.5 ppmv total oxygenate and/or nitrogenate in the hydrogen recycle stream 115. Thus, in some embodiments, the addition of oxygenate and/or nitrogenate as described herein may serve to activate and maintain such catalysts resulting in desirable conversion rates of reactants to aromatics as well as other benefits such as improved fouling characteristics and catalyst operating life as described herein. Thus, catalyst activity or activation may be controlled with addition or removal of an oxygenate and/or nitrogenate. In an additional embodiment, a nitrogenate may similarly be added to the catalytic reactor system 100 and function to activate the aromatization catalyst, wherein such catalyst might otherwise be inactive or display insufficient activity in the absence of the addition of nitrogenate.

In an embodiment, the addition of the oxygenate and/or nitrogenate increases the useful life of the aromatization catalyst. As used herein, the term "useful life" may refer to the time between when the aromatization catalyst is placed in service, and when one or more parameters indicate that the aromatization catalyst should be removed from service (e.g., reaching a $T_{eq}$ maximum or limit). While the time, location, and manner of oxygenate and/or nitrogenate addition can affect the useful life of the aromatization catalyst, in embodiments the addition of the oxygenate and/or nitrogenate can increase the useful life of the catalyst by at least about 5 percent, at least about 15 percent, or at least about 25 percent. In other embodiments, the addition of the oxygenate and/or nitrogenate can increase the useful life of the catalyst by at least about 50 days, at least about 150 days, or at least about 250 days.

In an embodiment, the addition of the oxygenate and/or nitrogenate increases the selectivity and/or productivity of the aromatization catalyst. As used herein, "selectivity" may refer to the ratio of aromatic products produced by the aromatization catalyst for a given set of reagents. As used herein, "productivity" may refer to the amount of aromatic products produced by the aromatization catalyst per unit of feed and unit time. When the oxygenate and/or nitrogenate is added to the aromatization catalyst, an increased amount of one or more aromatic compounds may be produced. Specifically, the addition of the oxygenate and/or nitrogenate to the aromatization catalyst may increase the amount of aromatics in the effluent by at least about 20 percent, at least about 10 percent, at least about 5 percent, or at least about 1 percent over pre-addition levels. Also, the addition of the oxygenate and/or nitrogenate to the aromatization catalyst may increase the catalyst selectivity to desirable aromatics, such as benzene. In an embodiment, the addition of the oxygenate and/or nitrogenate to the aromatization catalyst may increase the catalyst selectivity to desirable aromatics by at least about 20 percent, at least about 10 percent, at least about 5 percent, or at least about 1 percent over pre-addition levels. In a specific example, benzene production may be increased from about 40 weight percent to about 48 weight percent of the effluent, without decreasing the production of any of the other aromatics. Such would indicate an increase in catalyst production and selectivity. In some embodiments, such effects may be independent of each other such as when benzene production is increased with no increase in overall aromatic production.

In an embodiment, the methods described herein may yield alternative benefits. For example, if the aromatic production level is maintained at a specified level, then the reactors may be operated at lower temperatures, which results in a longer catalyst life. Alternatively, if the reactor temperatures are maintained at a specified level, then the space velocity within the reactors may be increased, which produces additional amounts of aromatic products. Finally, the methods described herein may yield additional advantages not specifically discussed herein.

In an embodiment, the effects of the addition of the oxygenate and/or nitrogenate are fast and reversible. For example, when the oxygenate and/or nitrogenate is added to the aromatization catalyst, the oxygenate and/or nitrogenate begins to affect the aromatization catalyst (e.g., increases activity) within about 100 hours, within about 50 hours, within about 10 hours, or within about 1 hour. Similarly, once the oxygenate and/or nitrogenate is removed from the aromatization catalyst, the aromatization catalyst may revert to the catalyst activity, aromatics yield, or aromatics selectivity seen prior to the addition of the oxygenate and/or nitrogenate within about 500 hours, within about 100 hours, within about 50 hours, or within about 10 hours.

In an embodiment, the existing oxygenate and/or nitrogenate content of a stream to which the oxygenate and/or nitrogenate is to be added is measured and/or adjusted prior to addition of the oxygenate and/or nitrogenate. For example and with reference to FIG. 1, one or more feed streams such as hydrocarbon feed 101, recycle stream 119, combined feed stream 102, hydrogen recycle 116, or combinations thereof may be measured for oxygenate and/or nitrogenate content and the oxygenate and/or nitrogenate content thereof adjusted prior to the addition of the oxygenate and/or nitrogenate. Likewise, the same streams may be measured for nitrogenate content and/or the nitrogenate content thereof adjusted prior to the addition of the nitrogenate. Generally, a raw or untreated feed stream such as hydrocarbon feed stream 101 may contain some amount of oxygenate or nitrogenate when it enters the catalytic reaction system described herein. In addition, depending on the plant configuration, the duration of feed storage and weather conditions, the feed may absorb oxygenates or nitrogenates from the air. In order to accurately control the amount of oxygenate or nitrogenates entering one or more of the aromatization reactors (e.g., reactors 10, 20, 30, 40), the amount of oxygenate and/or nitrogenate in one or more feed streams to the reactors may be measured, adjusted, or both.

In an embodiment, the oxygenate and/or nitrogenate content of a given stream such as a feed stream may be measured, for example with a real-time, in-line analyzer. In response to such measurement, the oxygenate and/or nitrogenate content of the stream may be adjusted by treating and/or adding oxygenate and/or nitrogenate to the stream to obtain a desired amount of oxygenate and/or nitrogenate therein. In an embodiment, a control loop links the analyzer to a treater and an oxygenate and/or nitrogenate injector such that the amount of oxygenate and/or nitrogenate in one or more streams is controlled in response to an oxygenate and/or nitrogenate set point for such streams. In an embodiment the measuring and/or adjusting of the oxygenate and/or nitrogenate content and associated equipment such as treaters and/or chemical injectors are included as part of the purification process 80. The oxygenate and/or nitrogenate treaters vary based on the type and amounts of oxygenate and/or nitrogenate. In embodiments where the oxygenate comprises water, beds of sorbent materials may be used. These sorbent beds are commonly known as driers. In embodiments where the oxygenate comprises oxygen, the use of treaters which convert the oxygen to water can be used in combination with driers. In further embodiments where the nitrogenate comprises a basic chemical, beds of sorbent materials may be used.

In an embodiment, one or more streams such as hydrocarbon feed 101, recycle stream 119, combined feed stream 102, hydrogen recycle 116, or combinations thereof are treated prior to the addition of oxygenate and/or nitrogenate thereto. In such an embodiment, measuring the oxygenate and/or nitrogenate content of the streams before such treated may optionally be omitted. If there is no apparatus for readily measuring the oxygenate and/or nitrogenate content of the feed, then it is difficult to reliably maintain a desired level in the aromatization reactors.

Treating one or more streams prior to the addition of the oxygenate and/or nitrogenate may aid in the overall control of the amount of water and/or ammonia in one or more streams entering the aromatization reactors by removing variability in the oxygenate and/or nitrogenate content in such streams. Treating such streams provides a consistent, baseline amount of oxygenate and/or nitrogenate in such streams for the addition of oxygenate and/or nitrogenate to form an oxygenated stream such as reactor feed stream 106. When the reactor feed is sufficiently free of oxygenates and/or nitrogenates, precise quantities of the oxygenate and/or nitrogenates can be added to the reactor feeds such that the amount of oxygenate and/or nitrogenates in the reactors may be reliably maintained. In an embodiment, the purification process 80 may include a hydrocarbon dryer that dries the hydrocarbon feed (e.g., streams 101, 119, and/or 102) to a suitable water level. In other embodiments, the purification process 80 may include a reduced copper bed (such as R3-15 catalyst available from BASF) or a bed of triethyl aluminum on silica for use in removing oxygenates. In still further embodiments, the reduced copper bed (such as BASF R3-15 catalyst) or a bed of triethyl aluminum on silica is used in combination with the hydrocarbon dryer. Similarly, the dryer 60 can be used to dry the hydrogen recycle and/or other process streams such as 101, 119, and/or 102 to a suitable water level. In an embodiment a suitable oxygenate level in one or more streams such as hydrocarbon feed 101, recycle stream 119, combined feed stream 102, hydrogen recycle 116, is such that the combination thereof produces less than about 1 ppmv, alternatively less than about 0.5 ppmv, or alternatively less than about 0.1 ppmv of water in the untreated hydrogen recycle stream 115. In an embodiment, one or more streams fed to the aromatization reactors such as hydrocarbon feed 101, recycle stream 119, combined feed stream 102, hydrogen recycle 116, or combinations thereof are substantially free of water following drying thereof. In an embodiment, the precise amount of the oxygenate and/or the nitrogenate may be added by partially or fully bypassing such treatment processes. Alternatively, the precise amount of the oxygenate and/or the nitrogenate may be added by partially or fully running the hydrogen recycle stream through a wet, e.g. spent, mole sieve bed.

In one embodiment, the amount of oxygenate added to the aromatization process may be regulated to control the water content in the hydrogen recycle stream 115. Specifically, the amount of oxygenate present in one or more of the reactors 10, 20, 30, and 40 may be controlled by addition of the oxygenate as described and monitoring the amount of water exiting the last reactor, for example the amount of water in effluent stream 114, the hydrogen recycle 115 (upstream of dryer 60), or both. Having a sufficient water level present in the hydrogen recycle 115 indicates that sufficient oxygenate is present in the reactors 10, 20, 30, and 40 so that the catalyst is activated as described herein. However, the water level in the hydrogen recycle stream 115 should also be limited because excess water can decrease the useful life of the catalyst. Specifically, the upper limit of water addition should be determined based on the long-term catalyst activity. In various embodiments, the amount of oxygenate added to the catalytic reactor system 100 is controlled such that the hydrogen recycle stream 115 contains from about 1 ppmv to about 100 ppmv, alternatively from about 1.5 ppmv to about 10 ppmv, or alternatively from about 2 ppmv to about 4 ppmv of water. In related embodiments, the amount of nitrogenate added to the aromatization process may be regulated to control the ammonia content in the hydrogen recycle stream 115 in many of the same ways used for the oxygenate.

In another embodiment, the amount of oxygenate and/or nitrogenate added to the aromatization process may be regulated to control the catalyst activity or to preserve the useful life of an aromatization catalyst. The catalyst activity can be measured by a number of methods including the endotherm, or $\Delta T$, across one or more reactors or alternatively $T_{eq}$. Measurements of activity such as reactor temperature, inlet temperature, yield-adjusted temperature, fouling rate, etc. compare activities at a given conversion of reactants in the reaction zone. As used herein, the term "yield-adjusted temperature" or "$T_{yld}$" refers to the average catalyst bed temperature in a lab-scale reactor system which has been adjusted to a specified yield (conversion) level. As used herein, the term "$T_{eq}$" refers to the equivalent reactor weighted average inlet temperature (WAIT) that would be required to run a catalytic aromatization reaction to a specified conversion at a standard set of reactor operating conditions such as hydrocarbon feed rate, recycle hydrogen-to-hydrocarbon molar ratio, average reactor pressure, and concentration of feed-convertible components. $T_{eq}$ can either be established by running at standard conditions or by using a suitable correlation to estimate $T_{eq}$ based on measured values of reactor variables. As used herein $T_{eq}$ parameters include running the catalytic aromatization reaction to about 88 wt % conversion of $C_6$ convertibles at a hydrogen-to-hydrocarbon ratio of about 4.0, a space velocity of about 1.2 $hr^{-1}$, in a six adiabatic reactor train with the inlet pressure to the last reactor at about 50 psig, with a feed composition comprising a $C_6$ fraction greater or equal to 90 wt %; a $C_5$ fraction less than or equal to 5 wt %; and a $C_7^+$ fraction less than or equal to 5 wt %. As used herein, the conversion of $C_6$ convertibles refers to the conversion of $C_6$ molecules with one or fewer branches into aromatic compounds. In various embodiments, the amount of oxygenate and/or nitrogenate added to the catalytic reactor system 100 is regulated such that the $T_{eq}$ is from about 900° F. to about 1000° F., from about 910° F. to about 960° F., or from about 920° F. to about 940° F. Furthermore, because any increase in catalyst activity is evidenced by a decrease in $T_{eq}$, the increase in catalyst activity can also be measured as a percentage decrease in the $T_{eq}$ of an equivalent reactor system running an equivalent dry hydrocarbon feed. In various embodiments, the amount of oxygenate added to the catalytic reactor system 100 is controlled such that the $T_{eq}$ is from about 0 percent to about 25 percent, alternatively from about 0.1 percent to about 10 percent, or alternatively from about 1 percent to about 5 percent less than the $T_{eq}$ of an equivalent reactor system running an equivalent substantially dry hydrocarbon feed, for example resulting in less than about 1 ppmv water in the hydrogen recycle stream 115, alternatively less than about 0.5 ppmv total water. In related embodiments, the amount of nitrogenate added to the aromatization process may be regulated to control the catalyst activity in many of the same ways used for the oxygenate.

Furthermore, the use of the oxygenate and/or nitrogenate in the catalytic reactor system may have a beneficial effect on the fouling rate of the catalyst. Catalysts may have a useful life beyond which it is no longer economically advantageous to use the catalyst. A commercially valuable catalyst will exhibit a relatively low and stable fouling rate. It is contemplated that the use of the oxygenate and/or nitrogenate as described herein increases and maintains the potential life of the catalyst when operating under conditions substantially free of these chemicals, for example, containing less than about 1 ppmv total oxygenate in stream 107 alternatively less than about 0.5 ppmv total oxygenate in stream 107.

Various types of catalysts may be used with the catalytic reactor system described herein. In an embodiment, the catalyst is a non-acidic catalyst that comprises a non-acidic zeolite support, a group VIII metal, and one or more halides. Suitable halides include chloride, fluoride, bromide, iodide, or combinations thereof. Suitable Group VIII metals include iron, cobalt, nickel, ruthenium, rhodium, palladium, osmium, iridium, and platinum. Examples of catalysts suitable for use with the catalytic reactor system described herein are the AROMAX® brand of catalysts available from the Chevron Phillips Chemical Company of The Woodlands, Tex., and those discussed in U.S. Pat. No. 6,812,180 to Fukunaga entitled "Method for Preparing Catalyst", and U.S. Pat. No. 7,153,801 to Wu entitled "Aromatization Catalyst and Methods of Making and Using Same", each of which is incorporated herein by reference as if reproduced in their entirety.

Supports for aromatization catalysts can generally include any inorganic oxide. These inorganic oxides include bound large pore aluminosilicates (zeolites), amorphous inorganic oxides and mixtures thereof. Large pore aluminosilicates include, but are not limited to, L-zeolite, Y-zeolite, mordenite, omega zeolite, beta zeolite and the like. Amorphous inorganic oxides include, but are not limited to, aluminum oxide, silicon oxide, and titania. Suitable bonding agents for the inorganic oxides include, but are not limited to, silica, alumina, clays, titania, and magnesium oxide.

Zeolite materials, both natural and synthetic, are known to have catalytic properties for many hydrocarbon processes. Zeolites typically are ordered porous crystalline aluminosilicates having structure with cavities and channels interconnected by channels. The cavities and channels throughout the crystalline material generally can be of a size to allow selective separation of hydrocarbons.

The term "zeolite" generally refers to a particular group of hydrated, crystalline metal aluminosilicates. These zeolites exhibit a network of $SiO_4$ and $AlO_4$ tetrahedra in which aluminum and silicon atoms are crosslinked in a three-dimensional framework by sharing oxygen atoms. In the framework, the ratio of oxygen atoms to the total of aluminum and silicon atoms may be equal to 2. The framework exhibits a negative electrovalence that typically is balanced by the inclusion of cations within the crystal such as metals, alkali metals, alkaline earth metals, or hydrogen.

L-type zeolite catalysts are a sub-group of zeolitic catalysts. Typical L-type zeolites contain mole ratios of oxides in accordance with the following formula:

$$M_{2/n}O.Al_2O_3.xSiO_2.yH_2O$$

wherein "M" designates at least one exchangeable cation such as barium, calcium, cerium, lithium, magnesium, potassium, sodium, strontium, and zinc as well as non-metallic cations like hydronium and ammonium ions which may be replaced by other exchangeable cations without causing a substantial alteration of the basic crystal structure of the L-type zeolite. The "n" in the formula represents the valence of "M", "x" is 2 or greater; and "y" is the number of water molecules contained in the channels or interconnected voids with the zeolite.

Bound potassium L-type zeolites, or KL zeolites, have been found to be particularly desirable. The term "KL zeolite" as used herein refers to L-type zeolites in which the principal cation M incorporated in the zeolite is potassium. A KL zeolite may be cation-exchanged or impregnated with another metal and one or more halides to produce a platinum-impregnated, halided zeolite or a KL supported Pt-halide zeolite catalyst.

In an embodiment, the Group VIII metal is platinum. The platinum and optionally one or more halides may be added to the zeolite support by any suitable method, for example via impregnation with a solution of a platinum-containing compound and one or more halide-containing compounds. For example, the platinum-containing compound can be any decomposable platinum-containing compound. Examples of such compounds include, but are not limited to, ammonium tetrachloroplatinate, chloroplatinic acid, diammineplatinum (II) nitrite, bis-(ethylenediamine)platinum (II) chloride, platinum (II) acetylacetonate, dichlorodiammine platinum, platinum (II) chloride, tetraammineplatinum (II) hydroxide, tetraammineplatinum chloride, and tetraammineplatinum (II) nitrate.

In an embodiment, the catalyst is a large pore zeolite support with a platinum-containing compound and at least one organic ammonium halide compound. The organic ammonium halide compound may comprise one or more compounds represented by the formula $N(R)_4X$, where X is a halide and where R represents a hydrogen or a substituted or unsubstituted carbon chain molecule having 1-20 carbons wherein each R may be the same or different. In an embodiment, R is selected from the group consisting of methyl, ethyl, propyl, butyl, and combinations thereof, more specifically methyl. Examples of suitable organic ammonium compound is represented by the formula $N(R)_4X$ include ammonium chloride, ammonium fluoride, and tetraalkylammonium halides such as tetramethylammonium chloride, tetramethylammonium fluoride, tetraethylammonium chloride, tetraethylammonium fluoride, tetrapropylammonium chloride, tetrapropylammonium fluoride, tetrabutylammonium chloride, tetrabutylammonium fluoride, methyltriethylammonium chloride, methyltriethylammonium fluoride, and combinations thereof.

In an embodiment, the organic ammonium halide compound comprises at least one acid halide and at least one ammonium hydroxide represented by the formula $N(R')_4OH$, where R' is hydrogen or a substituted or unsubstituted carbon chain molecule having 1-20 carbon atoms wherein each R' may be the same or different. In an embodiment, R' is selected from the group consisting of methyl, ethyl, propyl, butyl, and combinations thereof, more specifically methyl. Examples of suitable ammonium hydroxide represented by the formula $N(R')_4OH$ include ammonium hydroxide, tetraalkylammonium hydroxides such as tetramethylammonium hydroxide, tetraethylammonium hydroxide, tetrapropylammonium hydroxide, tetrabutylammonium hydroxide, and combinations thereof. Examples of suitable acid halides include HCl, HF, HBr, HI, or combinations thereof.

In an embodiment the organic ammonium halide compound comprises (a) a compound represented by the formula $N(R)_4X$, where X is a halide and where R represents a hydrogen or a substituted or unsubstituted carbon chain molecule having 1-20 carbons wherein each R may be the same or different and (b) at least one acid halide and at least one ammonium hydroxide represented by the formula $N(R')_4OH$, where R' is hydrogen or a substituted or unsubstituted carbon chain molecule having 1-20 carbon atoms wherein each R' may be the same or different.

The halide-containing compound may further comprise an ammonium halide such as ammonium chloride, ammonium fluoride, or both in various combinations with the organic ammonium halide compounds described previously. More specifically, ammonium chloride, ammonium fluoride, or both may be used with (a) as described previously, a compound represented by the formula $N(R)_4X$, where X is a halide and where R represents a hydrogen or a substituted or unsubstituted carbon chain molecule having 1-20 carbons wherein each R may be the same or different and/or (b) as described previously, at least one acid halide and at least one organic ammonium hydroxide represented by the formula $N(R')_4OH$, where R' is a substituted or unsubstituted carbon chain molecule having 1-20 carbon atoms wherein each R' may be the same or different. For example, a first fluoride- or chloride-containing compound can be introduced as a tetraalkylammonium halide with a second fluoride- or chloride-containing compound introduced as an ammonium halide. In an embodiment, tetraalkylammonium chloride is used with ammonium fluoride.

EXAMPLES

Having described the methods for activating and enhancing the aromatization catalyst with an oxygenate and/or nitrogenate and controlling the amounts thereof by monitoring process parameters, the following examples are given as particular embodiments of the method disclosed and to demonstrate the practice and advantages thereof. For the following examples, water or oxygen was injected into the aromatization feed prior to the first reactor as shown in FIG. 1 and described herein, unless otherwise described in the examples. It is understood that the examples are given by way of illustration and are not intended to limit the specification or the claims to follow in any manner.

Example 1

In a first example, the water in the recycle hydrogen was maintained below about 1 ppmv. The experiment was conducted in a series of 6 adiabatic reactors operating at a liquid hourly space velocity of about 0.8 to about 1.2 $hr^{-1}$, a hydrogen-to-hydrocarbon ratio of about 3 to about 6, and a sixth reactor inlet pressure of about 50 psig. Each individual reactor was a radial flow reactor with an internal diameter of between about 3 and about 10 feet. The feed was treated prior to use such that less than about 1.0 ppmv of oxygenates were present. Thus, this configuration does not contain any added oxygenate and/or nitrogenate and can be used as a reference.

Example 2

Figure 3A:
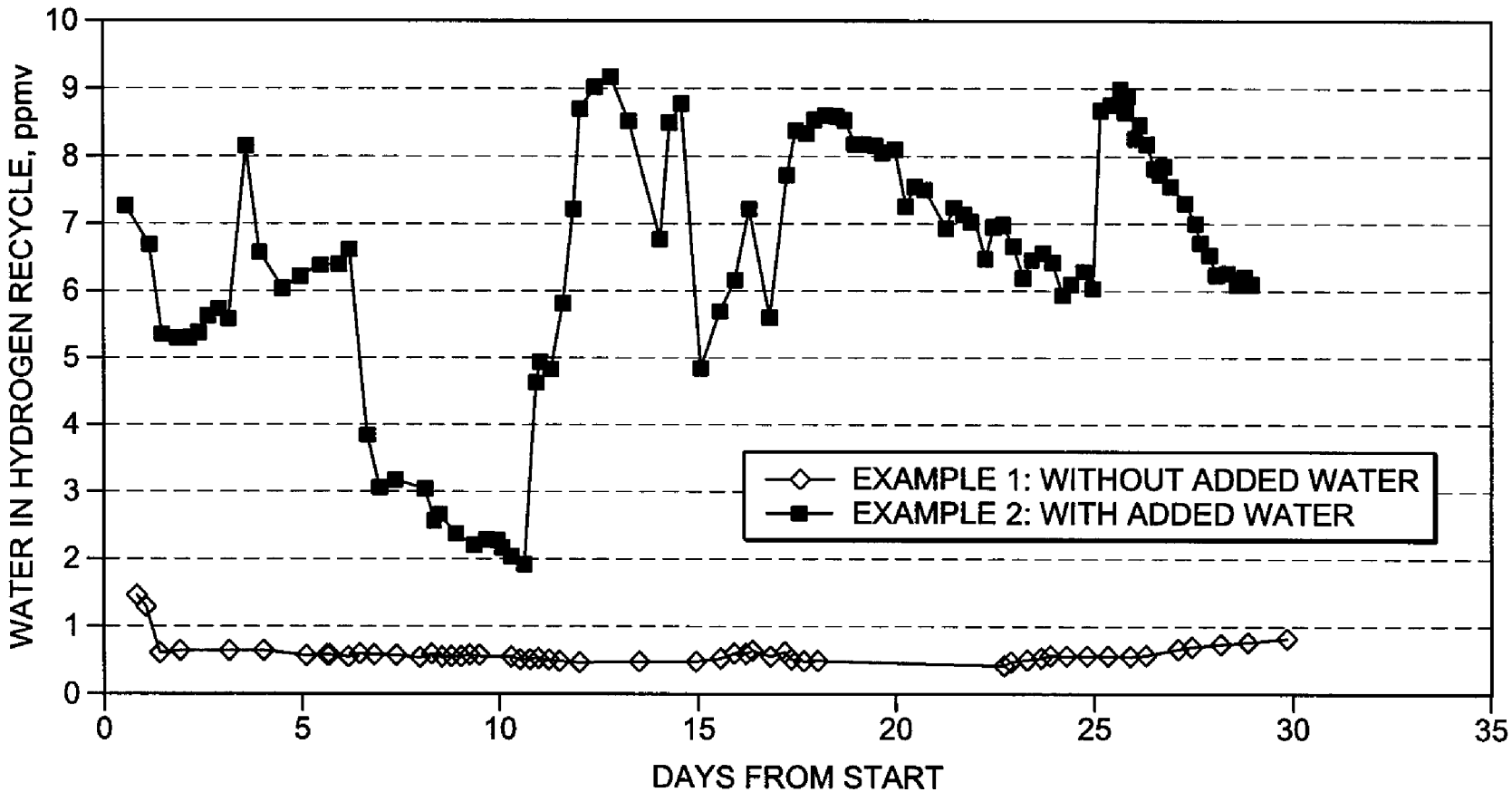
FIG. 3A is a chart illustrating the relationship between water content and time on stream for an aromatization catalyst.
Figure 3B:
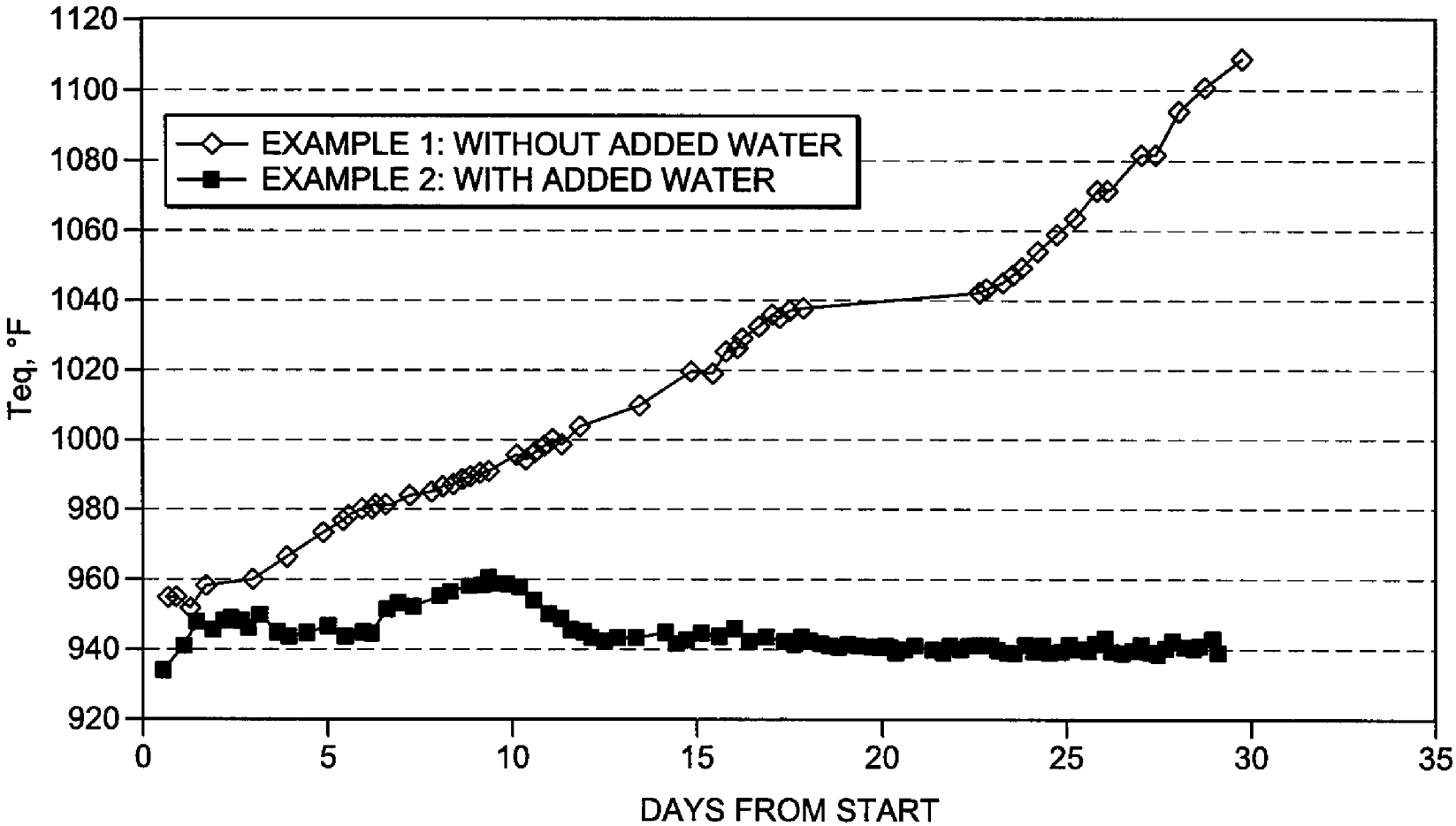
FIG. 3B is a chart illustrating the relationship between $T_{eq}$ and time on stream for an aromatization catalyst.

The process of example 1 was repeated except that the water in the recycle hydrogen was varied from about 2 to about 9 ppmv through the addition of water to streams 107 or 109 of FIG. 1. FIGS. 3A and 3B illustrate the effect that the presence of water as an oxygenate has on the $T_{eq}$ for the catalyst activity in examples 1 and 2. Specifically, FIG. 3A depicts the amount of water present in parts per million in the hydrogen recycle gas stream 115 for example 1 and example 2, whereas FIG. 3B depicts the $T_{eq}$ in degrees Fahrenheit for the same two examples. The hollow diamonds in FIGS. 3A and 3B are data from Example 1, run under substantially dry conditions, that is without the addition of any water to the system. The solid squares in FIGS. 3A and 3B are data from Example 2, the experiment in which the oxygenate was added to the system prior to the first aromatization reactor. As can be seen in FIGS. 3A and 3B, when the system was run under substantially dry conditions, the catalyst activity continually decreased, as represented by a continuous increase in $T_{eq}$ for the aromatization reactors. In contrast, when the same process used the same catalyst but with the addition of the oxygenate prior to the first aromatization reactor, the catalyst maintained its high initial activity as represented by the low and relatively constant $T_{eq}$ shown at the bottom of FIG. 3B.

The relationship between the water content of the hydrogen recycle stream and the catalyst activity may also be reversible. On about day 6 of the oxygenated run (Example 2) the addition of water to the system ceased, as shown by the reduced water in the hydrogen recycle on FIG. 3A. Starting at day 6, the catalyst activity decreased as evidenced by the increased $T_{eq}$ shown in FIG. 3B. By about day 10, the amount of water in the hydrogen recycle was about 2 ppmv, a level approaching the levels seen at the beginning of the substantially dry run, about 1.5 ppmv. When the addition of oxygenate resumed on day 10, the catalyst activity returned to its previous levels as evidenced by the decreased $T_{eq}$ shown in FIG. 3B. This increase and decrease in $T_{eq}$ forms a slight hump in the graph for Example 2 at the bottom of FIG. 3B between days 6 and 12.

Example 3

The relationship between the water content of the hydrogen recycle stream and the catalyst activity may also be catalyst specific as shown in this example. An experiment was conducted to determine the short-term affect of oxygenate addition on aromatization catalyst activity for two different catalyst formulations. The first catalyst was comprised of L-zeolite, impregnated with platinum, which had not been further impregnated with the halogens chloride, and fluoride (Pt/L-zeolite). The second catalyst was comprised of L-zeolite, impregnated with platinum, along with the halogens chloride, and fluoride (Pt/Cl/F/L-zeolite). In this example, the two catalysts were first brought to stable operating conditions without the addition of an oxygenate at about 3.0 liquid hourly space velocity (LHSV); about 140 psig; about 3.0 $H_2$/hydrocarbon feed ratio; at a temperature that achieved a significant aromatic yield. Once stable operations had been established the processes were then perturbed by the addition of equal amounts of oxygenate, specifically a trace amount of $O_2$ in the hydrogen feed, for a period of about 24 hours. The oxygenate addition was measured as water in the off-gas from the reactor. During these short-term perturbation tests, the catalyst bed temperatures were held constant. The response of the catalyst activity to the addition of oxygenate, and the subsequent cessation of oxygenate addition, was measured using the $T_{yld}$.

Figure 4:
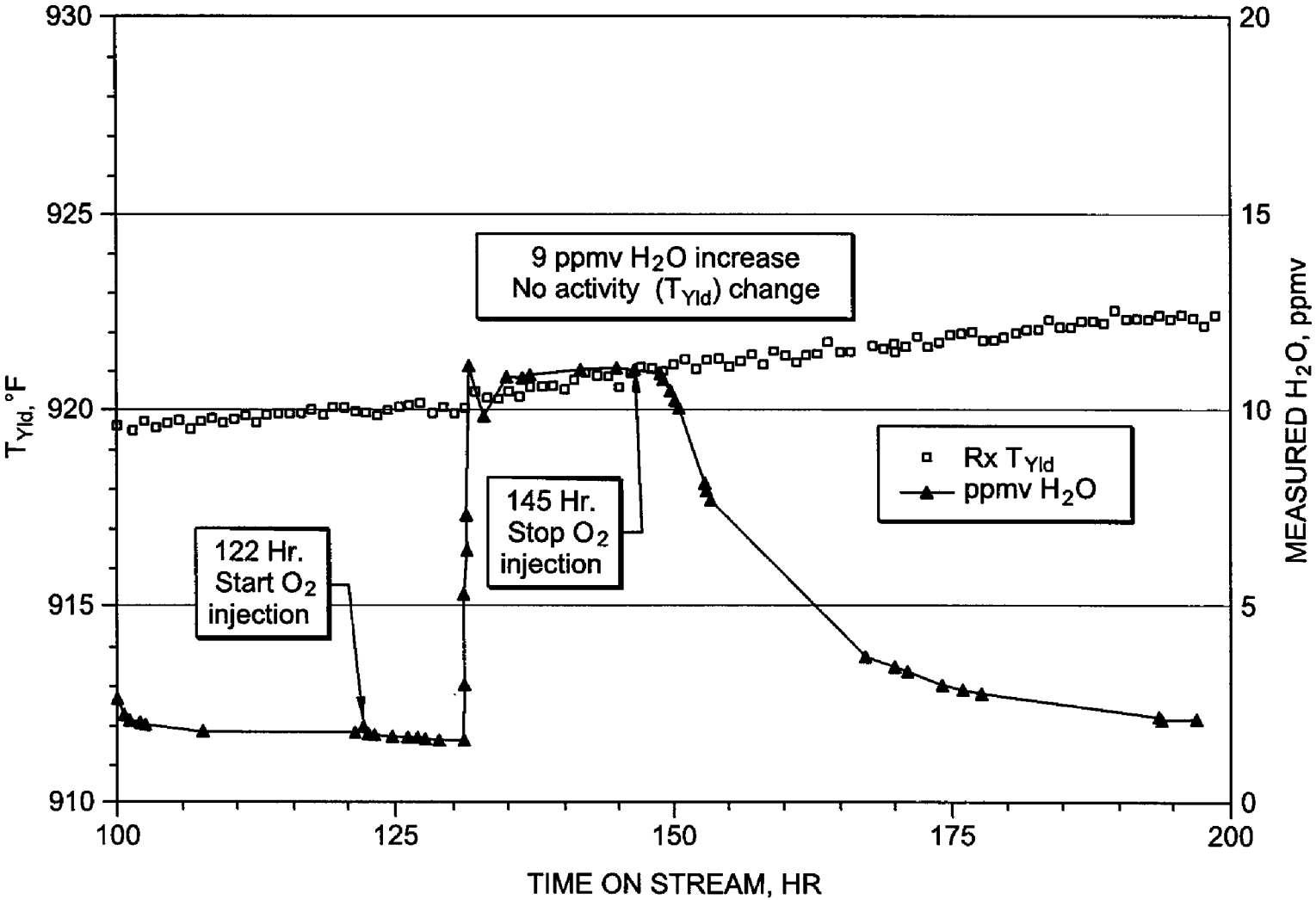
FIG. 4 is a chart illustrating the relationship between yield-adjusted temperature and time on stream for an aromatization catalyst.
Figure 5:
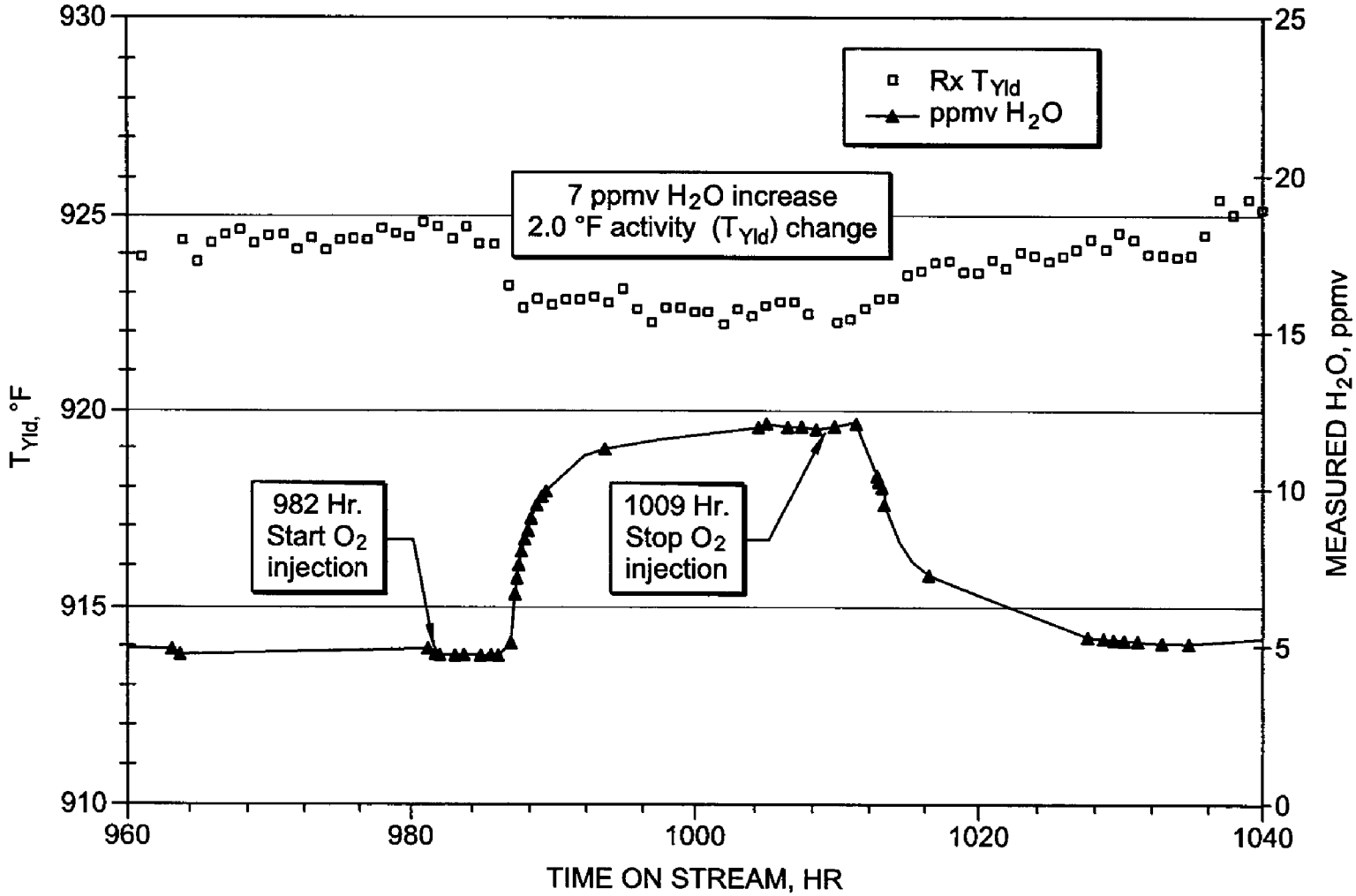
FIG. 5 is another chart illustrating the relationship between yield-adjusted temperature and time on stream for an aromatization catalyst.

As shown by the steady plot for $T_{yld}$ in FIG. 4, the presence of the oxygenate did not have an affect on the activity of the Pt/L-zeolite catalyst. Similarly, the removal of the oxygenate did not have an affect on the activity of the Pt/L-zeolite catalyst either, as the plot of $T_{yld}$ in FIG. 4 remained steady before, during, and after the oxygenate injection. In contrast, FIG. 5 shows that the addition of the oxygenate increased the activity of the Pt/Cl/F/L-zeolite catalyst, as evidenced by the decrease in the $T_{yld}$ for the aromatization reactor during the interval of oxygenate injection. Moreover, when the oxygenate addition was terminated, the $T_{yld}$ returned to its previous, higher levels. As noted previously, for an endothermic aromatization reaction as carried out in the Examples, a higher $T_{yld}$ is associated with a lower catalyst activity and vice-versa.

Example 4

Figure 6:
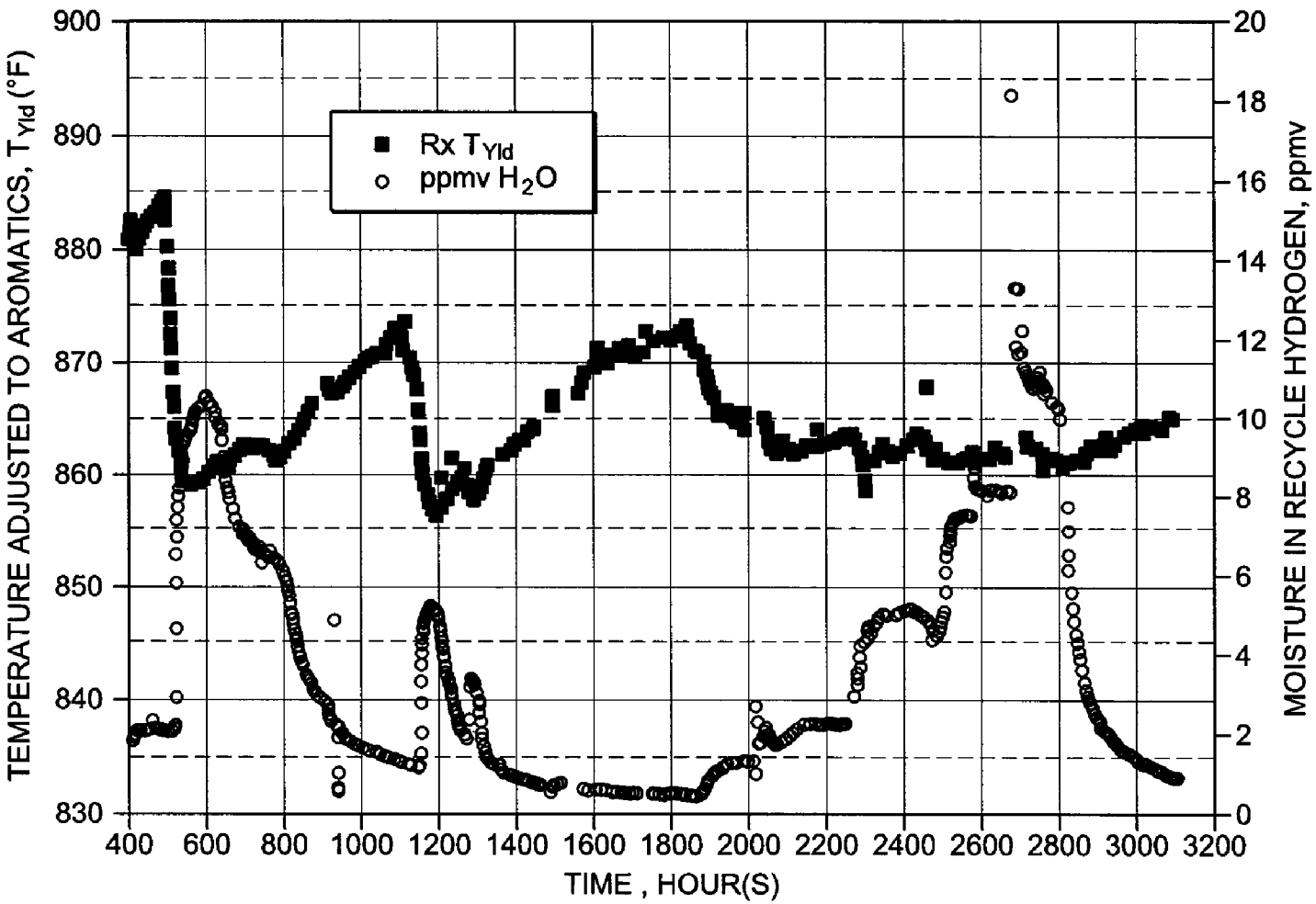
FIG. 6 is a chart illustrating the relationship between the yield-adjusted temperature ($T_{yld}$) and time on stream for an aromatization catalyst.

This example further exemplifies of the use of oxygenates to improve and control catalyst activity. In this example a feed of having a $C_6$ concentration of less than or equal to about 63 wt %; a $C_5$ concentration of less than or equal to about 5 wt %; a $C_7$ concentration of less than or equal to about 27 wt % $C_7$; and a $C_8^+$ concentration of less than or equal to about 10 wt % was fed to a single reactor. The single reactor was operating at a pressure of about 65 psig, with a hydrogen-to-hydrocarbon molar ratio of about 2.0 and a liquid hourly space velocity of about 1.6 $hr^{-1}$. The downflow reactor was a packed bed reactor with an internal diameter of about 1.0 inch. The feed was pretreated using a combination of Type 4A molecular sieves and reduced BASF-R3-15 (40 wt % copper) to less than about 1.0 ppmv oxygenate. During the run of this example, the amount of oxygenate in the reactor feed was varied by adjusting the flow rate of $O_2$ in a carrier gas of hydrogen being injected into the feed stream. The results of this example are presented in FIG. 6. As shown, the substantial variation in $T_{yld}$ corresponds to variations in the measured water in the recycle hydrogen stream.

Example 5

This experiment illustrates the effect that water has on the life of an aromatization catalyst. In this example, two side-by-side laboratory scale isothermal reforming reactor systems were started under the same process conditions, both using the same halogenated Pt/K-L zeolite catalyst. Both reactors exhibited the typical spike in water (measured in the reactor product gas) during the initial 4 to 6 hours of operation, which subsequently decayed for the remainder of the 50 hour low severity "break-in." Low severity conditions were 3.0 LHSV, 3.0 $H_2$/hydrocarbon, 140 psig, with 60% aromatics in the liquid product. At 50 hours on stream (HOS), both reactors were set to high severity. High severity conditions were 3.0 LHSV, 0.5 $H_2$/hydrocarbon, 140 psig, with 76% aromatics in the liquid product. Both reactors exhibited the typical spike in water in transition to high severity, which subsequently decayed. For the first 100 HOS, both reactors were subject to the same experimental conditions and both reactors had comparable performance.

Run 1 was continued from 50 to about 1600 HOS without the addition of water, e.g. was run substantially dry. Run 1 leveled off at about 2 ppmv of water in the off-gas by about 500 HOS. The water level in Run 1 stayed at about 2 ppmv through about 1600 HOS. In contrast, water was added to Run 2, the substantially wet run. Specifically, at 100 HOS the water level was increased in the second reactor, e.g. the reactor associated with Run 2, via controlled addition of trace oxygen in the hydrogen feed. The Run 2 moisture level reached about 8 ppmv water by 500 HOS, where it stayed through about 1600 HOS.

In this example, the Start of Run (SOR) yield-adjusted reactor temperatures for both Run 1 and Run 2 were about 940° F. The End of Run (EOR) temperature for this example was defined as 1000° F. At about 1600 HOS, the yield-adjusted reactor temperature for both runs is about 985 to 990° F., and thus both runs are approaching the EOR temperature. Consequently, at about 1600 HOS the water level in both Run 1 and Run 2 was increased by about 5 to 6 ppmv water, so that the Run 1 reactor off-gas increased to about 8 ppmv water and the Run 2 reactor off-gas increased to about 13.5 ppmv water. The Run 2 reactor continued to deactivate at the same rate. That is the increase from 8 to 13.5 ppmv water did not change the fouling rate or the catalyst activity. In contrast, the catalyst activity in the Run 1 reactor increased substantially when the water in the off-gas changed from 2 to 8 ppmv, as seen by the decrease in the reactor yield-adjusted temperature from 1600-1750 HOS. At about 1750 HOS, the Run 1 reactor activity began to decay again, but at a lower decay rate than prior to the water increase.

Figure 7:
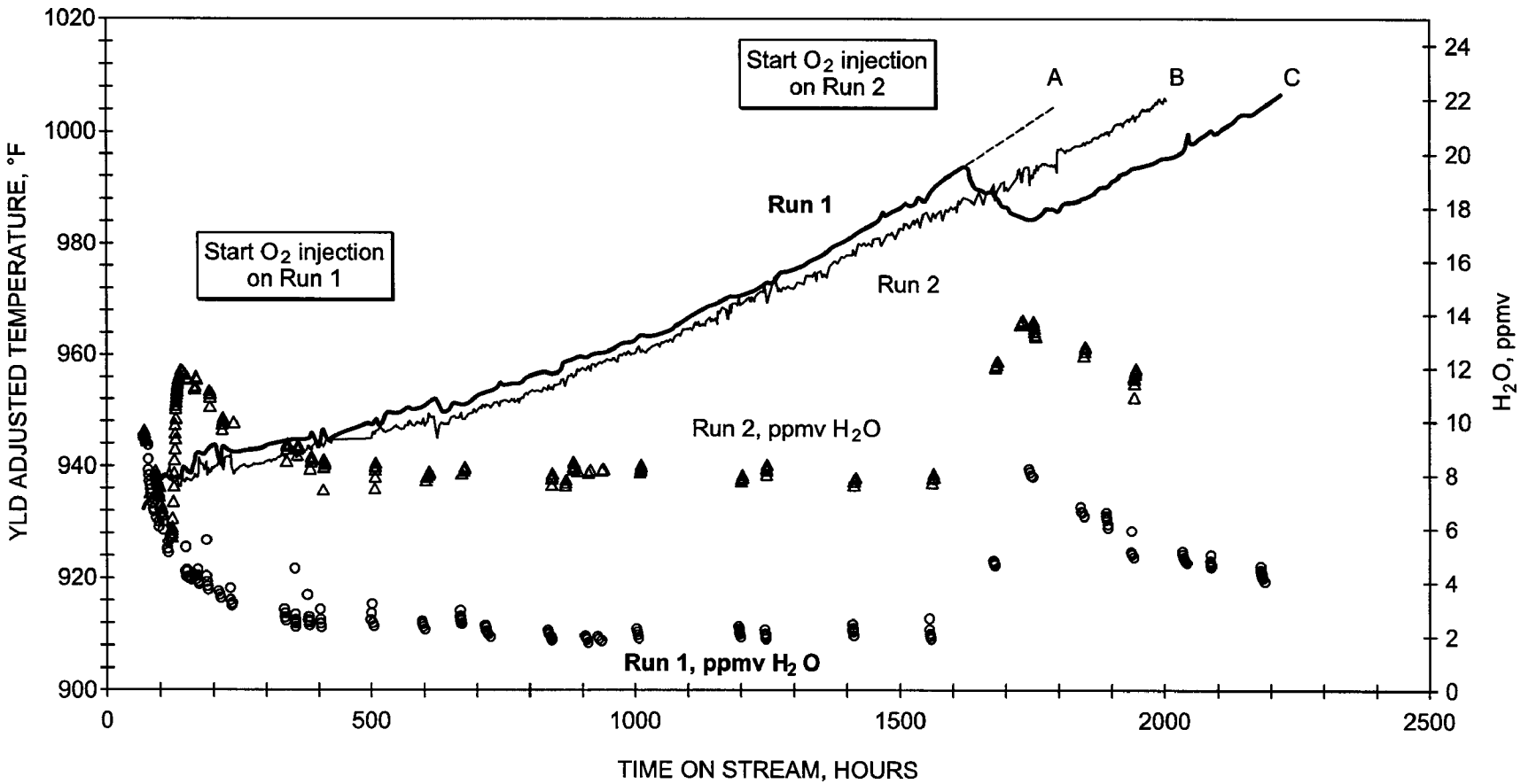
FIG. 7 is another chart illustrating the relationship between the yield-adjusted temperature ($T_{yld}$) and time on stream for an aromatization catalyst.
Figure 8A:
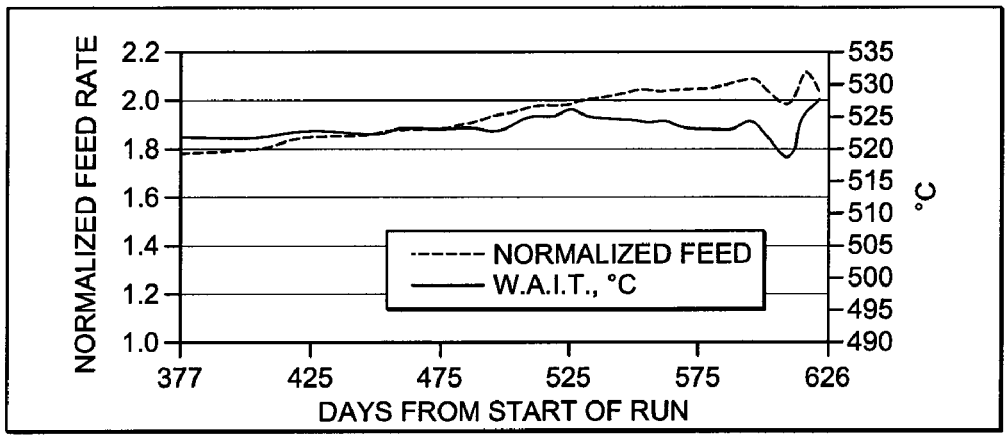
FIG. 8A is a chart illustrating the relationship between feed rate and time on stream for an aromatization catalyst.
Figure 8B:
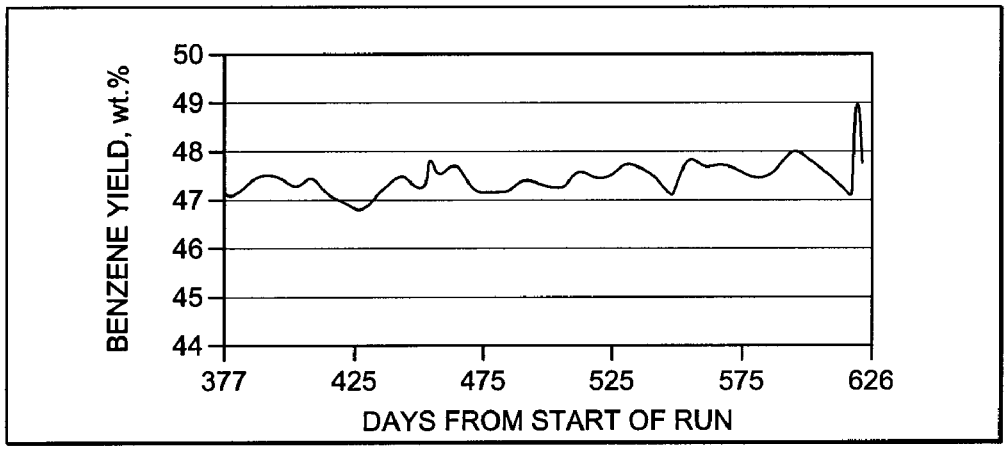
FIG. 8B is a chart illustrating the relationship between benzene yield and time on stream for an aromatization catalyst.
Figure 8C:
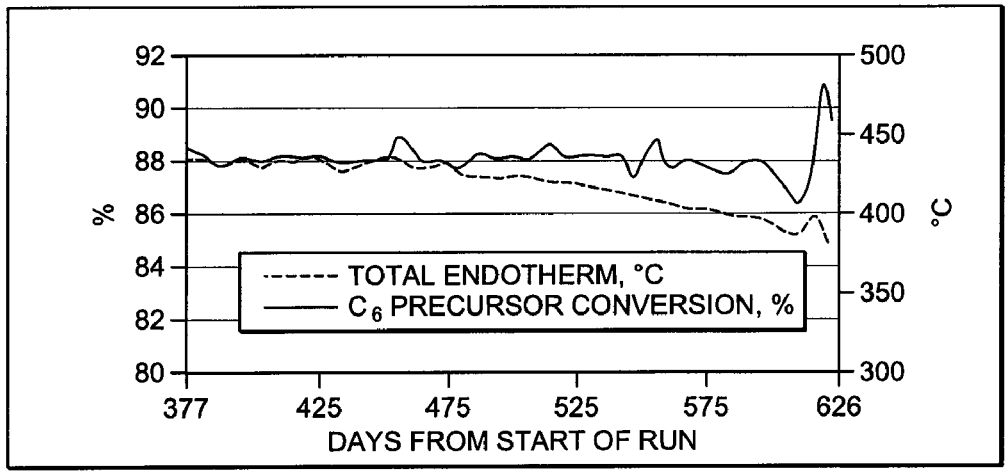
FIG. 8C is a chart illustrating the relationship between benzene conversion, endothermic activity, and time on stream for an aromatization catalyst.
Figure 8D:
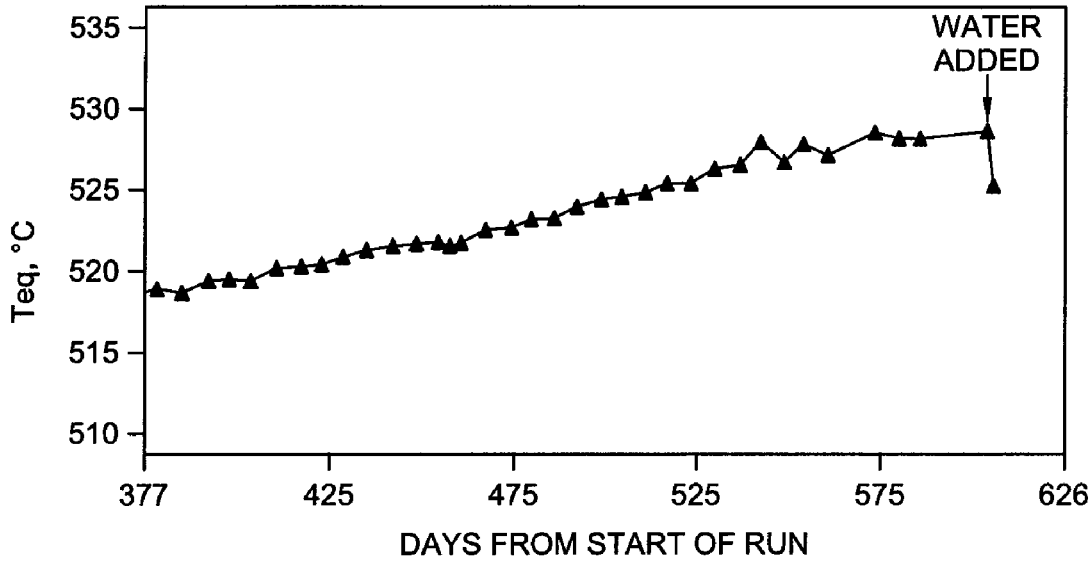
FIG. 8D is a chart illustrating the relationship between $T_{eq}$ and time on stream for an aromatization catalyst.

FIG. 7 illustrates the results of this example. No data is plotted during the first about 50 HOS of FIG. 7 which represents the start-up period in which the reactors are operated under non-standard operating conditions. Run 1 was used to predict point A and determine point C, whereas Run 2 was used to determine point B. The substantially dry run, Run 1, is predicted to reach EOR at point A. The substantially wet run, Run 2, which had about 8 ppmv of water for most of the run, had an EOR at about point B. However, the best run length is achieved by operating at moderately-low water (e.g. 2 ppmv) through most of the cycle and then adding water to the feed to achieve 8 ppmv water in the off-gas just prior to reaching the EOR temperature. This approach is better than the two previous, and results in endpoint C. The difference between points A and B is about 200 hours, which is an increase of about 10% over point A, and the difference between points B and C is about 200 hours. Thus, a late addition of water to the catalyst system can result in about 400 more hours of useful catalyst life, which is an increase of about 20% over the dry run.

Example 6

An experiment was conducted on a full-scale reactor system similar to the one described in FIG. 1. Specifically, the aromatization process was run under normal conditions to develop a baseline for the trial. FIGS. 8A-8D illustrate the reactor history and performance.

On day 623, water injection was started at stream 107 in FIG. 1 at a rate of 12 milliliters per minute to produce an estimated water content in the recycle gas of 5 ppmv. The water content in the recycle gas stream (stream 115 in FIG. 1) increased from 1.2 ppmv to 4 ppmv. On day 624, an increase in catalyst activity was observed, and the WAIT was decreased by 1.5° C. to 530° C., and the reactor space velocity ($hr^{-1}$) was increased by 0.75%. On day 625, the water injection rate was reduced from 12 ml/min to 6 ml/min to control catalyst activity increase and to improve $H_2$ production purity. The WAIT was decreased from 529° C. to 528.5° C., and the reactor was maintained at the higher space velocity. After day 626, the catalyst activity was expected to follow the activity decay of the previous catalyst charge, thus yielding an estimated additional about 150 days on stream. Table 1 shows the results:

TABLE 1

| | Days on Stream | | | | | | | |
|---|---|---|---|---|---|---|---|---|
| | 588 | 595 | 602 | 616 | 623 | 624 | 625 | 626 |
| WAIT, ° C. | 529 | 530 | 530.5 | 527 | 531.5 | 531.5 | 530 | 529 |
| Benzene Yield, Wt % | 47.4 | 47.7 | 48 | 47.4 | 47.1 | 48.6 | 48.9 | 47.8 |
| Toluene Yield, Wt % | 16.2 | 16.3 | 15.5 | 15.3 | 15.7 | 15.3 | 15.1 | 15.1 |
| $C_6$ Precursor Conversion, % | 87.4 | 88 | 88 | 86.3 | 87.7 | 90.7 | 90.8 | 89.5 |
| $C_6$ Precursor Selectivity to Benzene, Wt % | 89.4 | 86.7 | 87.2 | 87.1 | 85.4 | 86.5 | 87.7 | 85.9 |
| Total Endotherm, ° C. | 399.4 | 398.7 | 396.9 | 388 | 395.8 | 392.9 | 388.5 | 385.3 |
| Teq, ° C. | 528.6 | 528.3 | 528.3 | 528.6 | 528.7 | 525.4 | 523.6 | 523.9 |

Example 7

Figure 9:
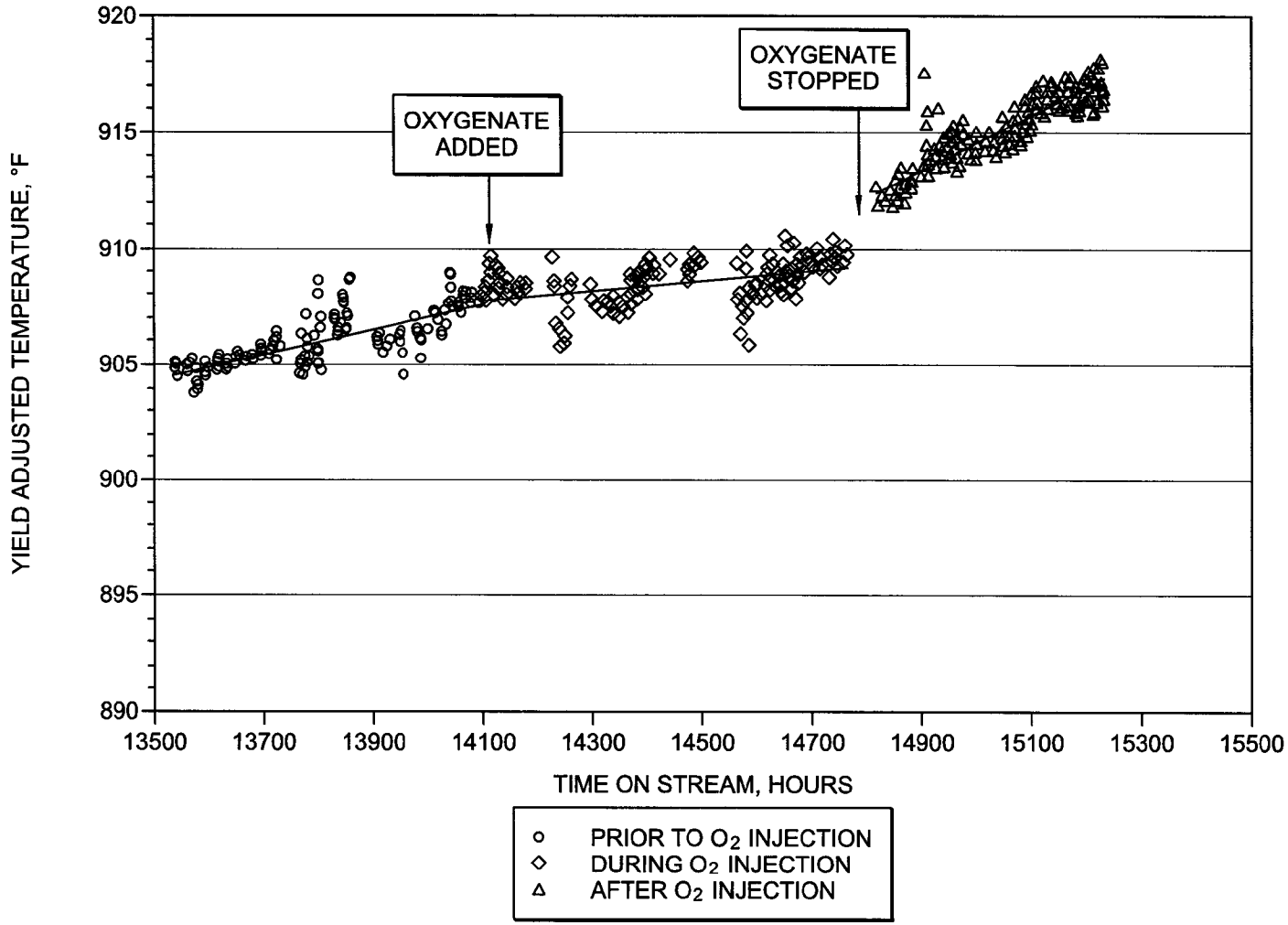
FIG. 9 is a chart illustrating the relationship between yield-adjusted temperature and time on stream for an aromatization catalyst.

The results reported in examples 7 and 8 were obtained using experimental units such as those described in examples 5 and 6 of U.S. Pat. No. 6,190,539 to Holtermann and entitled "Reforming using a bound halided zeolite catalyst." In this example and the following example, the experimental equipment was routinely operated with less than 1 ppmv $H_2O$ in the recycle hydrogen. The experimental equipment was modified so that oxygen could be added to the recycle hydrogen stream. This oxygen was then converted to water as it passed through the catalyst within the hydrofining section. The oxygen addition was then controlled by measuring the water level in the recycle hydrogen. In this example, oxygen was injected into the recycle and the resulting yield-adjusted catalyst average temperature was plotted in FIG. 9. Furnace temperature was held constant and changes in catalyst activity were monitored by measuring changes in the yield-adjusted catalyst temperature. Specifically, about 400 ppmv of $O_2$ in $H_2$ was added at a rate of 0.08 cubic centimeters per minute per gram of catalyst (cc/min·$g_{catalyst}$) starting about 14,100 hours. The oxygen addition rate was increased to about 0.17 cc/min·$g_{catalyst}$ at about 14,300 hours, and oxygen addition ended at about 14,800 hours. Linear regression of the temperature before injection, during injection, and after injection was conducted for the temperature values. As shown, the slope was lower during $O_2$ injection, indicating a lower deactivation rate during $O_2$ injection, compared to before and after the $O_2$ injection. Specifically, the fouling rate of the catalyst before the water addition was 0.13° F./day. The fouling rate of the catalyst during the water addition was 0.05° F./day. Finally, the fouling rate of the catalyst after the water addition was 0.28° F./day.

Example 8

In this example, furnace temperature was again held steady so that reactor endotherms could be monitored precisely with time and water content. This run operated at 65 psig, 1.6 LHSV, 2.0 $H_2$/hydrocarbon mole ratio.

Figure 10:
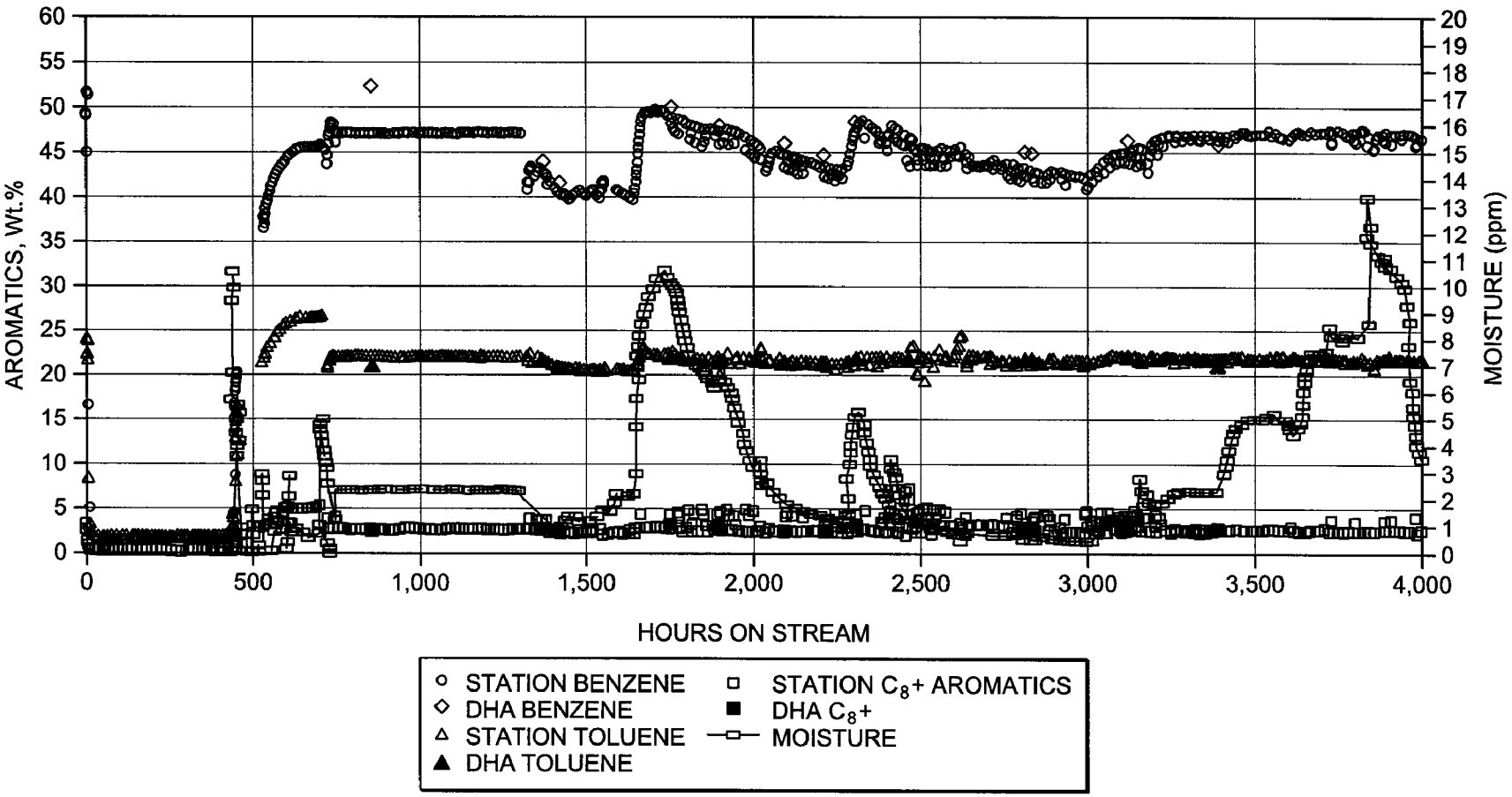
FIG. 10 is a chart illustrating the relationship between aromatic production and time on stream for an aromatization catalyst.

From the outset, there was low water concentrations (<2 ppmv, with levels reaching <1 ppmv at times) in the recycle hydrogen and the result was decreasing catalyst activity almost immediately following the extended reactor idle time at about 500 HOS. As shown in FIG. 10, when water was added to the reactor system via oxygen addition to the recycle gas at 1,600 HOS and activity was restored. When water addition to the aromatization reactor was stopped, the activity decayed once again in the period between 2,000 and 3,100 HOS. Subsequently, increasing water levels via oxygen addition caused an increase in the catalyst activity up to about 4 or 5 ppmv water. Further increases in water did not raise activity further. When water addition was stopped at 3,900 HOS, catalyst activity started to fall again immediately.

Figure 11:
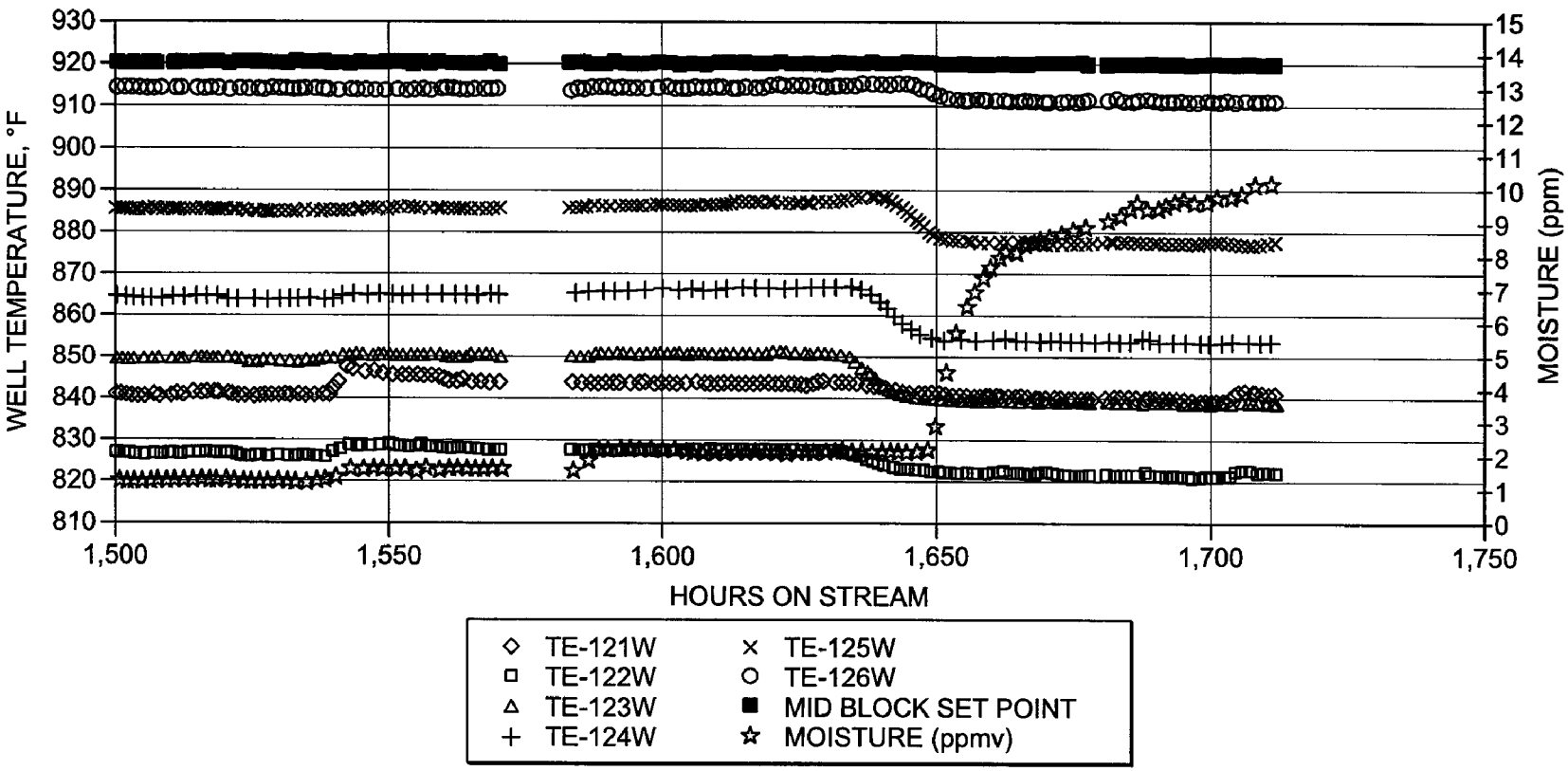
FIG. 11 is a chart illustrating the relationship between well temperature and time on stream for an aromatization catalyst.

The oxygen ($O_2$) addition was initiated upstream of the hydrofining system at 3,900 HOS. The reaction rate in the aromatization reactor started to increase in a (top down) wave through the reactor about 11 hours prior to the detection of increased water in the effluent hydrogen from aromatization reactor at 1,650 HOS. The increased reaction rate is indicated by the increase in the reactor endotherm (reduction in thermowell temperatures by as much as 10° F.). In FIG. 11, the internal thermowell temperatures during the run are plotted between 1,600 and 1,700 HOS during the time period of the first oxygen addition. It can be seen (in FIG. 11) that the reactor internal temperatures started to move (temperatures decreased, which indicates an increase in the reactor endotherm, and catalyst activity) about 11 hours prior to detection of water in the reactor outlet.

During periods of low moisture operation, only the conversion to benzene was adversely affected. The conversions to toluene and xylenes remained invariant. This behavior is illustrated in FIG. 10. When moisture levels were increase via oxygen addition at about 1,600 HOS, the benzene concentration in the effluent increase about 8% from 40% to 48%.

While preferred embodiments of the disclosure have been shown and described, modifications thereof can be made by one skilled in the art without departing from the spirit and teachings of the disclosure. The embodiments described herein are exemplary only, and are not intended to be limiting. Many variations and modifications of the disclosure disclosed herein are possible and are within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The discussion of a reference herein is not an admission that it is prior art to the present disclosure, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A hydrocarbon aromatization process comprising:

adding an oxygenate, to a hydrocarbon stream to produce an enhanced hydrocarbon stream containing from about 2 ppm to 12 ppm water;

contacting the enhanced hydrocarbon stream with an aromatization catalyst in a reaction zone, wherein the catalyst comprises a non-acidic L-zeolite support, platinum, and one or more halides; and recovering an effluent comprising aromatic hydrocarbons.

2. The process of claim 1 further comprising separating a hydrogen recycle stream from the effluent, wherein the hydrogen recycle stream has a water content of from about 1 ppmv to about 100 ppmv.

3. The process of claim 2 further comprising drying the hydrogen recycle stream to produce a dried hydrogen recycle stream having a water content of less than about 1 ppmv and feeding the dried hydrogen recycle stream to the hydrocarbon stream or the enhanced hydrocarbon stream.

4. The process of claim 1 further comprising controlling the addition of the oxygenate to the hydrocarbon stream to maintain one or more process parameters within a desired range.

5. The process of claim 1 further comprising controlling the addition of the oxygenate to the hydrocarbon stream to increase the production of one or more aromatic compounds in the reaction zone effluent by at least about 1 percent over pre-addition levels.

6. The process of claim 1 further comprising controlling the addition of the oxygenate to the hydrocarbon stream to increase the catalyst selectivity to benzene in the reaction zone effluent by at least about 1 percent over pre-addition levels.

7. The process of claim 1 further comprising prior to the addition of the oxygenate, treating the hydrocarbon stream to remove all or a portion of any oxygenates therein to produce a treated hydrocarbon stream.

8. The process of claim 7 wherein the oxygenate removed from the hydrocarbon stream comprises water, and wherein the treated hydrocarbon stream has a water content of less than about 1 ppmv.

9. The process of claim 1 wherein the aromatization process comprises a plurality of reactors, and the oxygenate is added to one or more of the reactors.

10. The process of claim 1 wherein the oxygenate comprises oxygen, oxygen-containing compounds, water, carbon dioxide, hydrogen peroxide, an alcohol, ozone, carbon monoxide, ketones, esters, aldehydes, carboxylic acids, lactones, or combinations thereof.

11. The process of claim 1 wherein the oxygenate comprises methanol, ethanol, propanol, isopropanol, butanol, t-butanol, pentanol, amyl alcohol, hexanol, cyclohexanol, phenol, or combinations thereof.

12. A hydrocarbon aromatization process comprising:

adding an oxygenate to a hydrocarbon stream to produce an enhanced hydrocarbon stream containing from about 2 ppm to 12 ppm water, to a hydrogen recycle stream to produce an enhanced recycle stream containing from about 2 ppm to 12 ppm water, or to both;

contacting the enhanced hydrocarbon stream alone or in combination with the enhanced recycle stream with an aromatization catalyst, wherein the catalyst comprises a non-acidic L-zeolite support, platinum, and one or more halides;

recovering an effluent comprising aromatic hydrocarbons; and controlling the addition of the oxygenate to the hydrocarbon stream, the recycle stream, or both in order to maintain one or more process parameters within a desired range.

13. The process of claim 12 wherein the oxygenate is controlled to maintain a $T_{eq}$ across one or more reactors in the process.

14. The process of claim 13 wherein the $T_{eq}$ in the one or more reactors is decreased in comparison to a $T_{eq}$ that occurs in the absence of the oxygenate.

15. The process of claim 12 wherein the $T_{eq}$ decreases from about 0.1 percent to about 25 percent.

16. A hydrocarbon aromatization process comprising:

monitoring the presence of an oxygenate in the aromatization process;

monitoring at least one parameter of the aromatization process that indicates the activity of an aromatization catalyst, wherein the catalyst comprises a non-acidic L-zeolite support, platinum, and one or more halides; and modifying the amount of the oxygenate in the aromatization process to maintain the water content in the reaction zone from about 2 ppm to about 12 ppm, thereby affecting the parameter.

17. The process of claim 16 wherein the parameter is benzene production, and wherein upon the modification of the amount of oxygenate in the aromatization process, benzene production is increased by at least about 1 percent as compared to the benzene production prior to modifying the amount of the oxygenate.

18. The process of claim 16 wherein the parameter is a useful life of the aromatization catalyst, and wherein the useful life of the aromatization catalyst is increased by at least about 5 percent as compared to a similar catalyst in which the amount of oxygenate has not been modified.

19. The process of claim 16 wherein the modification comprises increasing an amount of oxygenate in the aromatization process to a first level, then decreasing the amount of oxygenate in the aromatization process to a second level.

20. The process of claim 19 wherein the parameter is a useful life of the aromatization catalyst, and wherein the modification increases the useful life of the aromatization catalyst as compared to either a first similar aromatization catalyst in which the amount of oxygenate is maintained at the first level or a second similar aromatization catalyst in which the amount of oxygenate is maintained at the second level.

* * * * *